US008951924B2

(12) United States Patent
Krueger et al.

(10) Patent No.: US 8,951,924 B2
(45) Date of Patent: Feb. 10, 2015

(54) BALLISTIC LAMINATE STRUCTURE HAVING TUBULAR SLEEVES CONTAINING BUNDLES OF UNIDIRECTIONAL FILAMENTS AND METHOD OF MANUFACTURING THE SAME

(76) Inventors: Ronald G. Krueger, New Braunfels, TX (US); Ronald L. Krueger, New Braunfels, TX (US)

( * ) Notice: Subject to any disclaimer, the term of this patent is extended or adjusted under 35 U.S.C. 154(b) by 312 days.

(21) Appl. No.: 12/924,046

(22) Filed: Sep. 16, 2010

(65) Prior Publication Data

US 2011/0003112 A1 Jan. 6, 2011

Related U.S. Application Data

(63) Continuation-in-part of application No. 11/986,624, filed on Nov. 21, 2007, now Pat. No. 7,910,503.

(60) Provisional application No. 61/277,001, filed on Sep. 18, 2009.

(51) Int. Cl.

| | |
|---|---|
| ***F41H 5/00*** | (2006.01) |
| ***B32B 27/04*** | (2006.01) |
| ***B32B 27/12*** | (2006.01) |

(Continued)

(52) U.S. Cl.

CPC ..... *F41H 5/0485* (2013.01)
USPC ..... 442/135; 442/59; 442/64; 442/65; 442/134; 442/169; 428/114; 428/195.1; 428/198; 428/201; 428/206; 2/2.5; 89/36.01; 89/36.05; 89/36.02

(58) Field of Classification Search

CPC ..... B32B 5/12; B32B 5/26; B32B 5/22; B32B 7/04; B32B 7/0458; B32B 7/14
USPC ..... 428/911, 98, 101, 102, 103, 105, 107, 428/112, 113, 114, 119, 195.1, 198, 201, 428/206, 210, 221, 292.1, 297.4, 298.1, 428/298.7, 299.1, 299.4, 299.7, 300.1, 428/300.7, 320.2, 321.1, 323, 357, 364, 428/375, 376, 378, 392, 394, 395, 411.1, 428/474.4, 474.7, 474.9, 475.5; 442/59, 442/134, 135, 64, 65, 71, 72, 74, 103–110, 442/166, 167, 168, 169, 170, 171, 178, 179, 442/180, 327, 330, 331, 332, 333, 366, 367, 442/394, 409, 414, 417; 89/336.01–36.17; 2/2.5; 156/62.8, 66.2, 176, 178, 179
See application file for complete search history.

(56) References Cited

U.S. PATENT DOCUMENTS

| | | | | |
|---|---|---|---|---|
| 5,160,776 | A * | 11/1992 | Li et al. | 428/109 |
| 5,935,678 | A * | 8/1999 | Park | 428/105 |
| 2007/0207689 | A1 * | 9/2007 | Taylor et al. | 442/135 |

OTHER PUBLICATIONS

"Align", Webster's Third New International Dictionary, May 6, 2013.*

(Continued)

*Primary Examiner* — Arti Singh-Pandey
*Assistant Examiner* — Frank Vineis
(74) *Attorney, Agent, or Firm* — Charles J. Rupnick

(57) ABSTRACT

A ballistic-resistant laminate assembly having a pair of films with an array of stacked pairs of first and second of unidirectionally-oriented bundles of high strength filaments therebetween, with the stacked filament bundles being arranged substantially interlinear with adjacent unidirectionally-oriented adhesions between the pair of films. The adhesions form continuous tubular sleeves between the pair of films with the stacked bundles of high strength filaments being substantially free floating yet contained therein. Optionally, the high strength filaments are coated or soaked in a liquid-to-solid phase change material or PCM.

21 Claims, 17 Drawing Sheets

(51) Int. Cl.

| | |
|---|---|
| ***B32B 3/00*** | (2006.01) |
| ***B32B 5/02*** | (2006.01) |
| ***B32B 27/02*** | (2006.01) |
| ***B32B 5/12*** | (2006.01) |
| ***F41H 5/04*** | (2006.01) |
| *F41H 5/08* | (2006.01) |
| *F41H 1/02* | (2006.01) |

(56) References Cited

OTHER PUBLICATIONS

Lee Y., Journal of Material Science, vol. 38 (2003), pp. 2825-2833.*

* cited by examiner

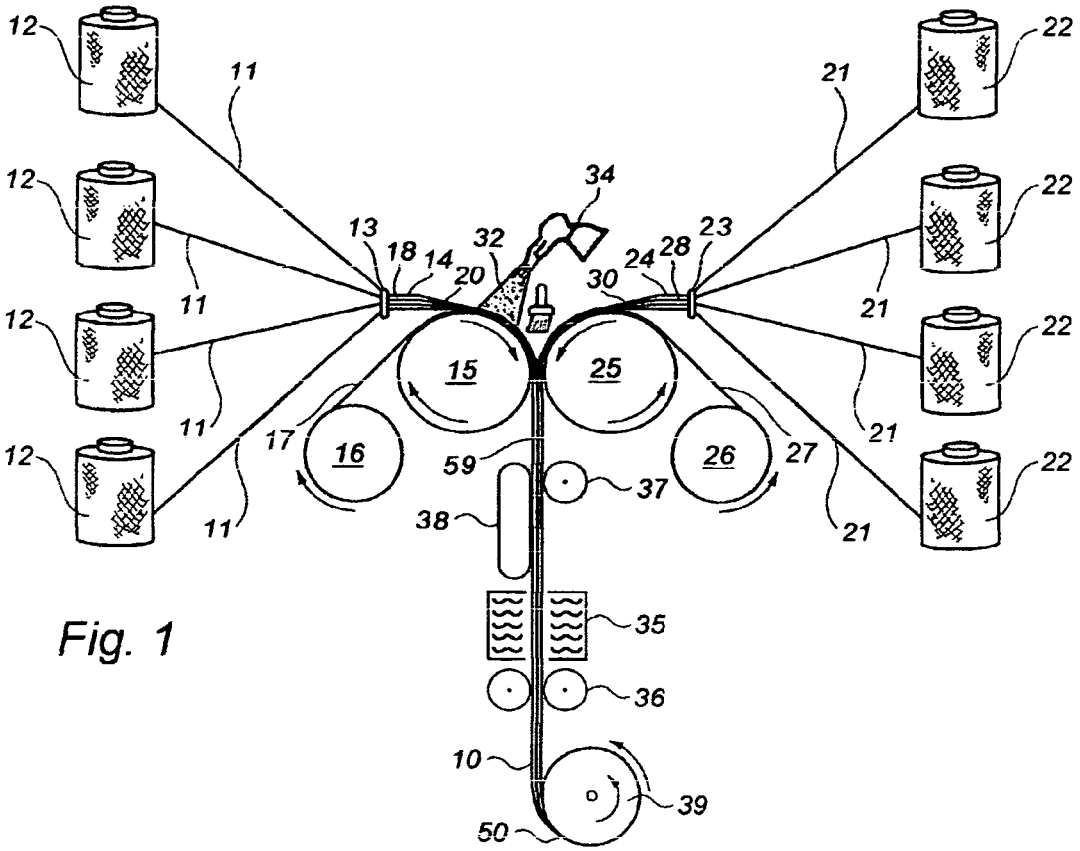
Fig. 1
Fig. 2
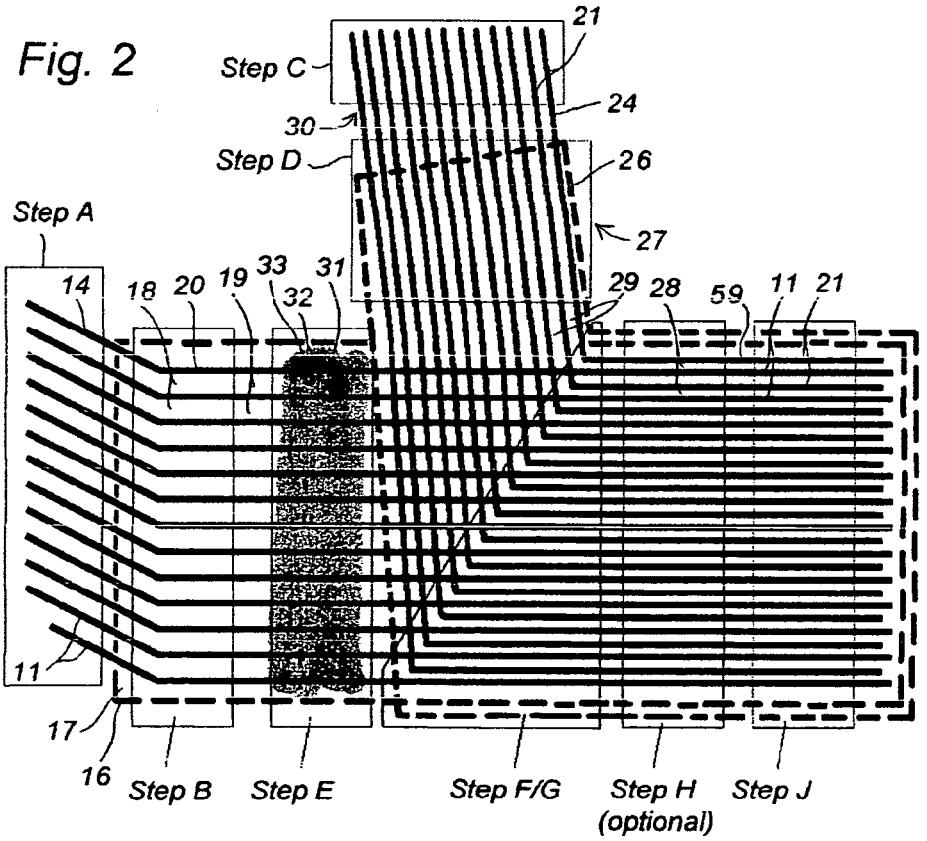

BALLISTIC LAMINATE STRUCTURE HAVING TUBULAR SLEEVES CONTAINING BUNDLES OF UNIDIRECTIONAL FILAMENTS AND METHOD OF MANUFACTURING THE SAME

This application claims priority benefit of U.S. Provisional Patent Application Ser. No. 61/277,001 for "Ballistic Laminate Structure" filed in the names of Ronald G. Krueger, Ronald L. Krueger, and Chris A. Yancy on Sep. 18, 2009, the complete disclosure of which is incorporated herein by reference, and this application is a continuation-in-part of U.S. patent application Ser. No. 11/986,624 for "Ballistic Laminate Structure" filed in the name of Ronald G. Krueger, Ronald L. Krueger, and Chris A. Yancy on Nov. 21, 2007, now U.S. Pat. No. 7,910,503 the complete disclosure of which is also incorporated herein by reference.

FIELD OF THE INVENTION

The present invention relates generally to a ballistic laminate structure in sheet form, and a method of fabricating a ballistic laminate structure.

BACKGROUND OF THE INVENTION

Unidirectional fiber materials are used in ballistic-resistant structures and are disclosed, e.g., in U.S. Pat. Nos. 4,916,000; 4,079,161; 4,309,487 and 4,213,812. A non-woven ballistic-resistant laminate referred to by the trademark "Spectra-Shield" is manufactured by Allied-Signal, Inc. The laminate structure is used in soft body armor to protect the wearer against high-velocity bullets and fragments. "Spectra-shield" was made by first forming a non-woven unidirectional tape, which was composed of unidirectional polyethylene fibers and an elastic resin material that held the fibers together. The resin penetrated the fibers, effectively impregnating the entire structure with the resin product. Two layers, or arrays, of the unidirectional tape were then laminated together (cross-plied) at right angles to form a panel. The panel was then covered on both sides with a film of polyethylene. The film prevented adjacent panels from sticking together when the panels were layered in the soft body armor. The final panel was heavier and stiffer than desired for use as a ballistic-resistant panel. The weight and stiffness were due in part to the penetration of the entire structure with the resin product.

Composite ballistic-resistant structures are disclosed, e.g., in U.S. Pat. Nos. 6,846,548 and 7,211,291, having a plurality of filaments arranged in a fibrous web that is held together in a unitary structure by a domain matrix. The domain matrix comprises a plurality of separated matrix islands that individually connect, or bond, at least two filaments, to thereby hold the filaments in a unitary structure. Portions of the filament lengths within the unitary structure are free of matrix islands, causing the domain matrix to be discontinuous. The composite may be formed into cross-plied structures.

Non-woven ballistic-resistant laminates without resins are disclosed, e.g., in U.S. Pat. Nos. 5,437,905; 5,443,882; 5,443,883 and 5,547,536. A sheet of non-woven ballistic-resistant laminate structure was constructed of high performance fibers without using resins to hold the fibers together. Instead of resin, thermoplastic film was bonded to outer surfaces of two cross-plied layers of unidirectional fibers to hold the fibers in place. The film did not penetrate into the fibers. A sufficient amount of film resided between the bonded layers to adhere the layers together to form a sheet. Bonding the two layers of unidirectional fibers cross-plied to one another was necessary to meet structural requirements of the ballistic-resistant panel, such as impact force distribution. The individual sheets were placed loosely in a fabric envelope of an armored garment to form a ballistic-resistant panel.

However, known ballistic-resistant laminates are limited in their ability to provide a light weight and flexible ballistic-resistant structure in either sheet or laminate form.

SUMMARY OF THE INVENTION

The present invention is a ballistic-resistant laminate assembly having a first thin and flexible film and a pair of first and second stacked arrays of unidirectionally-oriented bundles of high strength filaments with filament bundles of the second array each being arranged substantially aligned with and stacked onto adjacent filament bundles of the first array and further being in at least intermittent contact therewith. Respective first surfaces the filament bundles of the first array are arranged in close proximity to the first surface of the first film, with substantially continuous thin linear portions of the first surface of the first film being in gaps between adjacent spaced apart filament bundles of the first array, and respective second surfaces of the filament bundles of the first array opposite the respective first surfaces thereof being arranged facing away from the first surface of the first film. Respective first surfaces of the filament bundles of the second array are arranged facing away from the first surface of the first film, with respective second surfaces of the filament bundles of the second array being arranged substantially aligned with the filament bundles of the first array and stacked thereon in close proximity thereto. At least intermittent deposits of the coupling agent are further coupled between at least a portion of each of the filament bundles of the first array and the respective adjacent filament bundles of the second array.

According to one aspect of the ballistic-resistant laminate assembly, the ballistic-resistant laminate assembly also includes a second thin and flexible film opposite from the first film. The second film having a first surface thereof that is arranged in close proximity to first surfaces of the filament bundles of the second array. At least intermittent deposits of the coupling agent are further coupled between at least corresponding portions of the first surface of the first film and the first surface of the second film in the gaps between adjacent spaced apart filament bundles of the first and second arrays.

According to another aspect of the ballistic-resistant laminate assembly, the first and second films are further films selected from the group of films consisting of plastic films, thermoplastic films, and metallic films.

According to another aspect of the ballistic-resistant laminate assembly, the coupling agent is further a coupling agent selected from the group of coupling agents consisting of an adhesive, and a polymer.

Other aspects of the invention are detailed herein, including methods for making the ballistic-resistant laminate structure.

BRIEF DESCRIPTION OF THE DRAWINGS

The foregoing aspects and many of the attendant advantages of this invention will become more readily appreciated as the same becomes better understood by reference to the following detailed description, when taken in conjunction with the accompanying drawings, wherein:

FIG. 1 illustrates by example and without limitation a novel method for making an exemplary novel ballistic-resistant laminate structure;

FIG. 2 is a plan view of the novel ballistic-resistant laminate structure that illustrates by example and without limitation one exemplary novel method for making the same;

FIG. 26 through FIG. 30 illustrate one alternative embodiment of the novel laminate structure wherein filament bundles of the first and second arrays are stacked and adhered together instead of lying side by side, and substantially continuous thin lengthwise strip portions of the surface films that show between adjacent spaced apart filament bundles of the first and second arrays are adhered together around the stacked filament bundles of the first and second arrays, wherein:

FIG. 26 is a plan view of the ballistic-resistant laminate structure that illustrates by example and without limitation the above alternative method for making the same;

FIG. 27 is a pictorial view of the ballistic-resistant laminate structure that illustrates by example and without limitation the alternative method for making the same;

FIG. 28 is a close-up cross-section view that illustrates a stage in the alternative method for making the ballistic-resistant laminate structure;

FIG. 29 is a cross-section view that illustrates the spaced apart filament bundles of the first array substantially aligned and overlaid with the spaced apart filament bundles of the second array;

FIG. 30 illustrates the filament bundles of the first and second arrays being compressed between the first and second films;

DETAILED DESCRIPTION OF PREFERRED EMBODIMENT

Figure 3:
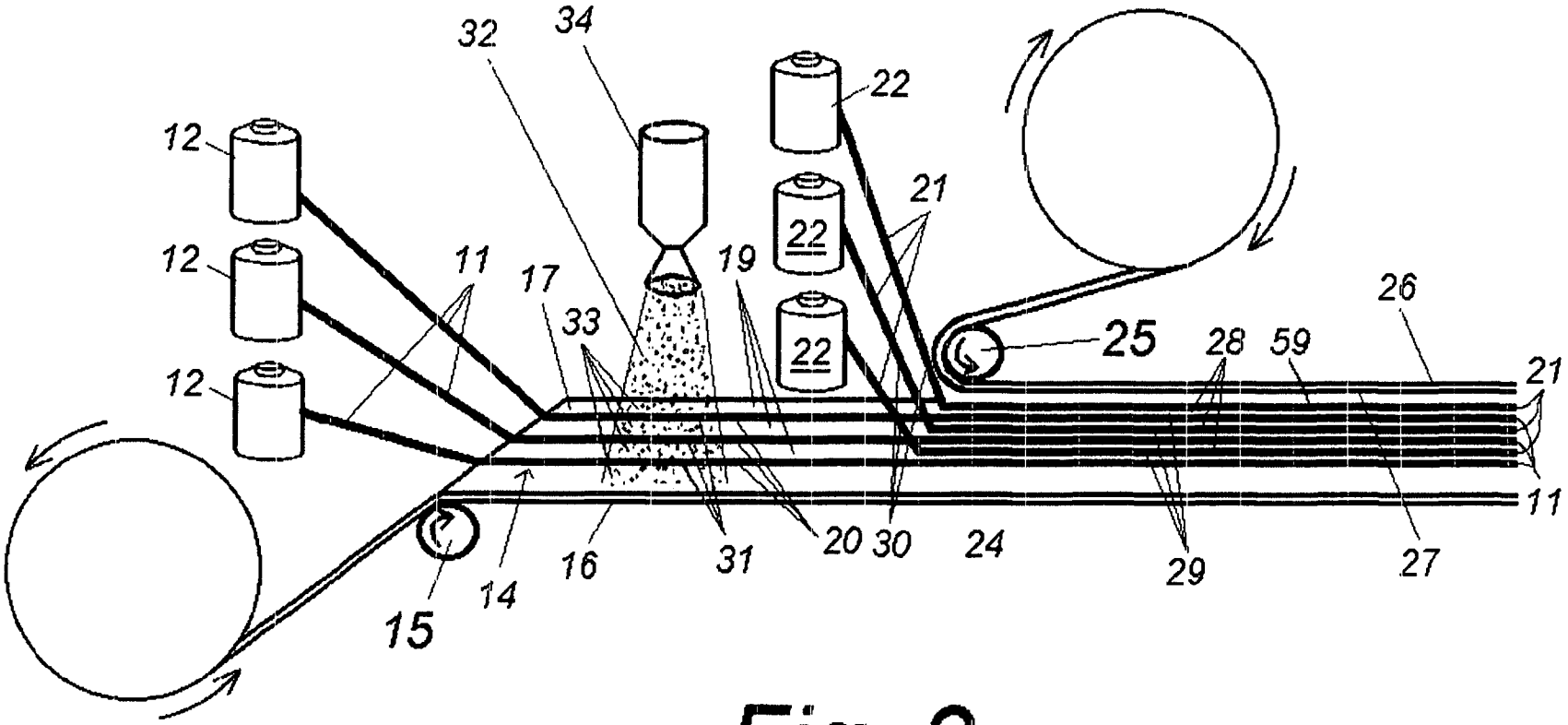
FIG. 3 is a pictorial view of the novel ballistic-resistant laminate structure that illustrates by example and without limitation one exemplary novel method for making the same.

In the Figures, like numerals indicate like elements.

Unidirectional high performance fiber materials composed, for example, of unidirectional polyethylene fibers, are well known as disclosed in the prior art by U.S. Pat. Nos. 4,916,000; 4,079,161; 4,309,487 and 4,213,812, which are incorporated in entirety herein by reference. Such high performance fiber materials are also known to be formed into composite ballistic-resistant structures as disclosed, for example, in U.S. Pat. Nos. 6,846,548 and 7,211,291, which are incorporated in entirety herein by reference. Alternatively, non-woven ballistic-resistant laminates are manufactured without resins as disclosed, for example, in U.S. Pat. Nos. 5,437,905; 5,443,882; 5,443,883 and 5,547,536, which are incorporated in entirety herein by reference.

First and second high strength filament bundles 11 and 21 of the present invention are elongated bodies of considerable length dimension in relation to their transverse dimensions of width and thickness. The term "filament" is used interchangeably with the term "fiber" and non-exclusively includes a monofilament, multifilament, yarn, ribbon, strip, and the like structures having regular or irregular cross-sectional areas. The filament bundles 11 and 21 for purposes of the present invention are formed of any group of fibers useful to make uni-directional tape and/or cross-plied structures. The preferred filament bundles 11 and 21 are highly oriented ultra high molecular weight polyethylene fiber, highly oriented ultra-high molecular weight polypropylene fiber, aramid fiber, polyvinyl alcohol fiber, polyacrylonitrile fiber, polybenzoxazole (PBZO) fiber, polybenzothiazole (PBZT) fibers, fiberglass, ceramic fibers or combinations thereof. Ultra-high molecular weight polyethylene's are generally understood to includes molecular weights of from about 500,000 or more, more preferably from about 1 million or more, and most preferably greater than about 2 million, up to an amount of approximately 5 million.

Known high strength filaments or fibers useful for filaments 11 and 21 of the invention include without limitation aramid fibers, fibers such as poly(phenylenediamine terephthalamide), both high and ultra-high-molecular-weight polyethylene, graphite fibers, ceramic fibers, nylon fibers, high modulus vinylon, liquid crystal polymer-based fiber, and glass fibers and the like. Aramid fiber is formed principally from aromatic polyamides. Exemplary aramid fibers include poly(-phenylenediamine terephthalamide) fibers produced commercially by DuPont Corporation of Wilmington, Del. under the trade names of Kevlar® 29, Kevlar® 49 and Kevlar® 129.

Polyvinyl alcohol (PV-OH) fibers are useful for the high strength filaments 11 and 21 of the invention at weight average molecular weights of at least about 100,000, preferably at least 200,000, more preferably between about 5,000,000 and about 4,000,000 and most preferably between about 1,500,000 and about 2,500,000 as disclosed in U.S. Pat. No. 4,559,267 to Kwon et al.

Detail on filaments of polybenzoxazoles (PBZO) and polybenzothiazoles (PBZT), may be found in "The Handbook of Fiber Science and Technology: Volume II, High Technology Fibers," Part D, edited by Menachem Lewin, hereby incorporated by reference.

Polyacrylonitrile (PAN) fibers useful in producing ballistic resistant articles are disclosed, for example, in U.S. Pat. No. 4,535,027.

The cross-sections of filaments 11 and 21 for use in this invention may vary widely. They may be circular, flat or oblong in cross-section. They also may be of irregular or regular multi-lobal cross-section having one or more regular or irregular lobes projecting from the linear or longitudinal axis of the fibers. It is particularly preferred that the filaments 11 and 21 be of substantially circular, flat or oblong cross-section Continuous length filaments 11 and 21 are most preferred although fibers that are oriented and have a length of from about 3 to 12 inches (about 7.6 to about 30.4 centimeters) are also acceptable and are deemed "substantially continuous" for purposes of this invention.

Both thermoset and thermoplastic resin particles, alone or in combination, may be used as the filaments 11 and 21. Useful thermosets include, but are not limited to, epoxies, polyesters, acrylics, polyimides, phenolics, and polyurethanes. Useful thermoplastics include, but are not limited to, nylons, polypropylenes, polyesters, polycarbonates, acrylics, polyimides, polyetherimides, polyaryl ethers, and polyethylene and ethylene copolymers. Thermoplastic polymers possess improved environmental resistance, fracture toughness, and impact strength over thermosetting materials. Prepregs having thermoplastic domain matrices have extended shelf life, and greater resistance to environmental storage concerns.

The high strength filaments 11 and 21 and networks produced therefrom are formed into composite materials as the precursor or prepreg to preparing composite articles.

FIG. 1 illustrates by example and without limitation a method for making a ballistic-resistant laminate structure shown generally at reference numeral 10. Here, the method includes the following steps, but is not limited to the order recited.

The method includes a step A of forming a first or "left" plurality of bundles 11 of untwisted high strength filaments, also referred to as fibers. Alternatively, the filament bundles 11 are twisted to add loft to the filaments. The first plurality of filament bundles 11 may be supplied from separate creeled yarn packages 12, as shown here, or may be supplied from a warp beam (not shown). The filaments or fibers in the first plurality of filament bundles 11 are unidirectional, and the bundles are passed through a first or "left" comb guide 13 where the first plurality of filament bundles 11 are further parallelized and arrayed into a first or "left" array 14 formed of a single layer having a predetermined uniform number of filament bundles 11 per inch of width with adjacent filament bundles 11 each being spaced apart approximately a width or slightly less than a width of one filament bundle.

The method includes a step B in which the first single layer array 14 of filament bundles 11 are passed over a first or "left" film application roller or mandrel 15 where a first or "left" film 16 of thin and flexible polyethylene or other suitable material is applied to the first array 14 of filament bundles 11. As an alternative to polyethylene, the thin film 16 is optionally another suitable material, including by example and without limitation but not limited to, another plastic or thermoplastic material, or a metallic film such as a thin aluminum or steel foil material, or another metal film.

In step B, application of the first film 16 to the first array 14 of filament bundles 11 causes a first surface 17 of the first film 16 to be arranged in close proximity to the filament bundles 11 of the first array 14. As illustrated more clearly in subsequent Figures, substantially uniform and continuous spacings 18 between adjacent filament bundles 11 expose substantially continuous thin lengthwise portions 19 of the first surface 17 of the first film 16 as thin strips of the first surface 17 that show between adjacent spaced apart filament bundles 11. Substantially continuous surfaces 20 of the filament bundles 11 of the first array 14 that face away from the first surface 17 of the first film 16 are also exposed.

The method includes a step C of forming a second or "right" plurality of filament bundles 21 of twisted or untwisted high strength filaments or fibers. The second or "right" plurality of filament bundles 21 are supplied from separate creeled yarn packages 22, as shown here, or may be supplied from a warp beam (not shown). The filaments or fibers in the second plurality of filament bundles 21 are also unidirectional, and the bundles are passed through a second or "right" comb guide 23 where the second plurality of filament bundles 21 are further parallelized and arrayed into a second or "right" array 24 formed of a single layer having a predetermined uniform number of filament bundles 21 per inch of width with adjacent filament bundles 21 each being spaced apart approximately a width or slightly less than a width of one filament bundle.

The method includes a step D in which the second single layer array 24 of filament bundles 21 are passed over a second or "right" film application roller or mandrel 25 where a second or "right" film 26 of thin and flexible polyethylene or other suitable material is applied to the second array 24 of filament bundles 21. Application of the second film 26 to the second array 24 of filament bundles 21 causes a first surface 27 of the second film 26 to be arranged in close proximity to the filament bundles 21 of the second array 24. As illustrated more clearly in subsequent Figures, substantially continuous spacings 28 between adjacent filament bundles 21 expose substantially continuous thin lengthwise portions 29 of the first surface 27 of the second film 26 as thin strips of the first surface 27 that show between adjacent spaced apart filament bundles 21. Substantially continuous surfaces 30 of the filament bundles 21 of the second array 24 that face away from the first surface 27 of the second film 26 are also exposed.

The method includes a step E of depositing substantially continuous deposits 31 of a coupling agent 32, including any anchoring, bonding or adhering agent, onto the exposed surfaces 20 of the filament bundles 11 of the first array 14 that face away from the first film 16. The coupling agent 32 is any anchoring, bonding or adhering agent of a type compatible with each of the first and second films 16 and 26 and the filament bundles 11 and 21 of the respective first and second arrays 14 and 24. By example and without limitation, the coupling agent 32 is selected from the group of anchoring, bonding or adhering agents consisting of: an adhesive agent, and a polymeric agent.

For example, when the first and second films 16 and 26 are a thin and flexible polyethylene or other polymer, including thermoplastic polymers, the coupling agent 32 is optionally a polymer or polymeric agent compatible with the films 16, 26. Alternatively, the coupling agent 32 is optionally an adhesive agent even when the films 16, 26 are a polymer material of a type compatible with a polymeric agent 32.

Alternatively, when the first and second films 16 and 26 are a thin and flexible metallic film such as a thin aluminum or steel foil material, or another metal film, the coupling agent 32 is a compatible adhesive agent.

Step E of the method includes, substantially simultaneously with the depositing substantially continuous deposits 31 of coupling agent 32 onto the exposed surfaces 20 of the filament bundles 11 of the first array 14, depositing substantially continuous deposits 33 of the coupling agent 32 onto the exposed substantially continuous thin lengthwise strip portions 19 of the first surface 17 of the corresponding first film 16 that show between the adjacent fiber bundles 11 of the first array 14.

When thermoset and thermoplastic resin particles, alone or in combination, are used as the filaments 11 and 21, the high viscosity of thermoplastic polymers does not affect the disconnected application of the coupling agent 32 into the laminate structure 10. Even at significantly increased amounts, thermoplastic prepregs of the laminate structure 10 are flexible structures. Prepregs containing thermosetting coupling agent 32 are relatively flexible and tacky prior to reaction.

The coupling agent 32 may contain polymeric material from polymeric powders, polymeric solutions, polymeric emulsions, chopped filaments, thermoset resin systems, and combinations thereof. Applications of these polymeric anchoring, bonding or adhering agent materials 32 may be by spray, droplets, emulsion, etc. When chopped filaments are used, heat and/or pressure can be used to consolidate the laminate structure 10, and the chopped filaments should melt at a temperature below that of the filaments 11 and 21.

The filaments 11 and 21, pre-molded if desired, may be pre-coated with a polymeric material (preferably an elastomer) prior to being arranged in the arrays 14, 24 as disclosed by example and without limitation, e.g., in U.S. Pat. Nos. 6,846,548 and 7,211,291, which are incorporated herein by reference.

Any suitable elastomeric material may be used for the anchoring, bonding or adhering agent materials 32. Representative examples of suitable elastomers of the elastomeric material have their structures, properties, and formulations together with cross-linking procedures summarized in the Encyclopedia of Polymer Science, Volume 5, "Elastomers-Synthetic" (John Wiley and Sons Inc., 1964). For example, any of the following materials may be employed: polybutadiene, polyisoprene, natural rubber, ethylene-propylene copolymers, ethylenepropylene-diene terpolymers, polysulfide polymers, polyurethane elastomers, chlorosulfonated polyethylene, polychloroprene, plasticized polyvinylchloride using dioctyl phthalate or other plasticers well known in the art, butadiene acrylonitrile elastomers, poly(isobutylene-co-isoprene), polyacrylates, polyesters, polyethers, fluoroelastomers, silicone elastomers, thermoplastic elastomers, copolymers of ethylene. Useful elastomers are block copolymers of conjugated dienes and vinyl aromatic monomers, including but not limited to, butadiene and isoproprene. Useful conjugated aromatic monomers, include but are not limited to, styrene, vinyl toluene and t-butyl styrene. Block copolymers incorporating polyisoprene may be hydrogenated to produce thermoplastic elastomers having saturated hydrocarbon elastomer segments. The polymers may be simple tri-block copolymers of the type A-B-A, multi-block copolymers of the type (AB)n (n=2 10) or radial configuration copolymers of the type R-(BA).times.(x=3 150): wherein A is a block from a polyvinyl aromatic monomer and B is a block from a conjugated diene elastomer. Many of these polymers are produced commercially by the Shell Chemical Co. and described in the bulletin "Kraton Thermoplastic Rubber", SC-68-81.

Low modulus elastomeric anchoring, bonding or adhering agent materials 32 may also include fillers such as carbon black, silica, glass micro-balloons, etc., and may be extended with oils and vulcanized by sulfur, peroxide, metal oxide, or radiation cure systems using methods well known to rubber technologists of ordinary skill. Blends of different elastomeric materials may be used together or one or more elastomeric materials may be blended with one or more thermoplastics. High density, low density, and linear low density polyethylene may be cross-linked to obtain a material of appropriate properties, either alone or as blends.

The proportion (volume percent) of polymeric or other anchoring, bonding or adhering agent materials 32 to the filaments 11 and 21 varies according to the rigidity, shape, heat resistance, wear resistance, flammability resistance and other properties desired. Other factors that affect these properties include the spatial density of the anchoring, bonding or adhering agent materials 32, void percentage within the arrays 14, 24 of the filaments 11 and 21, and other such variables related to the placement, size, shape, positioning and composition of the anchoring, bonding or adhering agent materials 32 and arrayed filaments 11 and 21.

The substantially continuous deposits 31 and 33 of an coupling agent 32 jointly anchor and maintain the filament bundles 11 and 21 of the respective first and second arrays 14 and 24 in the ballistic-resistant laminate structure 10 as a unitary structure. These anchors positionally fix the individual filament bundles 11 and 21 in relation to each other, yet permit the unitary ballistic-resistant laminate structure 10 to bend as a whole. The total volume of the substantially continuous deposits 31 and 33 is a fraction of the fiber volume that defines volumetric ratio density of the deposits 31 and 33.

The substantially continuous deposits 31 and 33 of the coupling agent 32 are not physically connected to one other, other than by the filament bundles 11 and 21. As such, the substantially continuous deposits 31 and 33 form a discontinuous anchoring, bonding or adhering material throughout the unitary ballistic-resistant laminate structure 10. However, as the substantially continuous deposits 31 and 33 permanently anchor relative locations of the filament bundles 11 and 21 in a fixed structure 10. The disconnects of the filament bundles 11 and 21 between the deposits 31 and 33 permits a higher volume percent of fiber in the structure 10 than would a continuous film of the coupling agent 32. Additionally, a robust structure is created, i.e., the deposits 31 and 33 of the coupling agent 32 bind the filament bundles 11 and 21 in a unitary structure that is easily handled without a tendency to separate or spread.

The discontinuous structure of the deposits 31 and 33 of coupling agent 32, which leave major sections of the filament bundles 11 and 21 uncoated, or without any of the coupling agent 32, are necessary to enhance bending of the resultant ballistic-resistant laminate structure 10. Amounts of coupling agent 32 used are sufficiently small to provide for uncoated filament segments in the prepreg and resultant products, and the deposits 31 and 33 may optionally include only those amounts of the coupling agent 32 that promote areas free of the agent 32.

By providing a distribution of the deposits 31 and 33, extremely high volumes of fiber can be incorporated to form a ballistic-resistant laminate structure 10 which has improved physical integrity during processing and use, such as handling and cutting the composite, and stacking unidirectional prepreg structure. The resulting laminate structure 10 maintains flexibility of the combined predominantly uncoated filament bundles 11 and 21 within the structure. Maintaining the integrity and ability to be handled, the laminate structure 10 retains its structure without yarn separation during processing and use. More than one layer of the laminate structure 10 bound with resin can be built up to form a variety of multi-layer laminates, such as 0/90, +45/−45, +30/−30, 0/60/120, 0/45/90/135, etc. These multi-layer composite laminates have been found to be resistant to impact, and more specifically resistant to ballistic impact.

Each section of the composite of the laminate structure 10 has a spatial distribution of the deposits 31 and 33 of coupling agent 32 which effectively hold together, and preferably bond, the filament bundles 11 and 21, providing areas with and without the coupling agent 32. Discontinuities between the deposits 31 and 33 of coupling agent 32 between unbonded portions of the filament bundles 11 and 21 permit flexibility of the laminate structure 10, while areas containing the deposits 31 and 33 remain as anchors that maintain multiple filament bundles 11 and 21 within the laminate structure 10 in a fixed relationship to each other. The deposits 31 and 33 of coupling agent 32 are extremely elongated with length dimensions running with, or parallel to, the length of the filament bundles 11 and 21 and are present only in an amount sufficient to bond adjacent filament bundles 11 and 21 and to maintain structural integrity in use. Although areas with the deposits 31 and 33 of the coupling agent 32 are not as flexible as areas free of the agent 32, the areas free of the agent 32 preferably impart flexibility to the laminate structure 10 as a whole. Consequently the laminate structure 10 can move more easily than a web where the fibers are fully encased in the coupling agent 32.

Step E of depositing substantially continuous deposits 31 and 33 of coupling agent 32 is accomplished by any suitable method. By example and without limitation, the depositing substantially continuous deposits 31, 33 of coupling agent 32 is accomplished using an applicator 34. For example, the depositing substantially continuous deposits 31, 33 of coupling agent 32 is accomplished by spraying an aerosol using a spraying applicator 34, atomizing and spraying a liquid using a spraying applicator 34, wiping a gel or liquid, or painting as with a brush or other mass applicator 34.

The method includes a step F of interlaying the spaced apart filament bundles 11 of the first array 14 with the spaced apart filament bundles 21 of the second array 24. Accordingly, the adjacent spaced apart filament bundles 11 of the first array 14 are laid into the substantially continuous spacings or gaps 28 between the adjacent spaced apart filament bundles 21 of the second array 24, and the adjacent spaced apart filament bundles 21 of the second array 14 are substantially simultaneously laid into substantially continuous spacings or gaps 18 between the adjacent spaced apart filament bundles 11 of the first array 14.

The method includes a step G of contacting the substantially continuous deposits 31 of the coupling agent 32 deposited on the exposed surfaces 20 of the filament bundles 11 of the first array 14 with the exposed substantially continuous thin lengthwise strip portions 29 of the first surface 27 of the second film 26 that show between adjacent spaced apart filament bundles 21 of the second array 24.

Step G of the method includes, substantially simultaneously with the contacting the substantially continuous deposits 31 of the coupling agent 32 deposited on the exposed surfaces 20 of the filament bundles 11 of the first array 14 with the exposed substantially continuous thin lengthwise strip portions 29 of the first surface 27 of the second film 26, contacting the exposed surfaces 30 of the filament bundles 21 of the second array 24 facing away from the first surface 27 of the second film 26 with the substantially continuous deposits 33 of the coupling agent 32 deposited on the exposed substantially continuous thin lengthwise strip portions 19 of the first surface 17 of the first film 16 that show between the adjacent fiber bundles 11 of the first array 14.

Step G of the method is optionally operated substantially simultaneously with step F of interlaying the spaced apart filament bundles 11 of the first array 14 with the spaced apart filament bundles 21 of the second array 24.

Optionally, step G of the method further includes the first and second application rollers or mandrels 15 and 25 pressing the first and second arrays 14 and 24 of fiber bundles 11 and 21 onto the first and second films 16 and 26. By example and without limitation, the first and second application rollers or mandrels 15 and 25 are operated in a known manner to apply pressure therebetween for compressing the first and second arrays 14 and 24 of fiber bundles 11 and 21 between the first and second films 16 and 26. Accordingly, the interlineated fiber bundles 11 and 21 are flattened and spread across the first surfaces 17 and 27 of the respective first and second films 16 and 26, as discussed more fully herein.

Alternatively, step D of the method in which the second film 26 is applied to the second array 24 of filament bundles 21 is omitted. Instead, the method includes a step H in which the second film 26 is applied to the second array 24 of filament bundles 21 at a later stage after accomplishment of step F of interlaying the spaced apart filament bundles 11 of the first array 14 with the spaced apart filament bundles 21 of the second array 24, and after accomplishment of the portion of step G of contacting the surfaces 30 of the filament bundles 21 of the second array 24 with the substantially continuous deposits 33 of the coupling agent 32 deposited on the exposed substantially continuous thin lengthwise strip portions 19 of the first surface 17 of the first film 16 that show between the adjacent fiber bundles 11 of the first array 14, which portion of step G of the method is optionally operated substantially simultaneously with the interlaying of step F.

When step D of the method is omitted, and the method includes substitution of the optional step H, the substituted step H is operated following step G. Optional step H, when present, includes passing the interlayered first and second filament bundles 11 and 21 of the first and second arrays 14 and 24 over the second or "right" film application roller or mandrel 25 where a second or "right" film 26 of thin and flexible polyethylene or other suitable material is applied to the second array 24 of filament bundles 21.

Optional step H, when present, includes contacting the substantially continuous deposits 31 of the coupling agent 32 deposited on the exposed surfaces 20 of the filament bundles 11 of the first array 14 with the substantially continuous thin lengthwise strip portions 29 of the first surface 27 of the second film 26.

The method includes a step J of anchoring, bonding or otherwise adhering at least a portion of the exposed surfaces 20 of the filament bundles 11 of the first array 14 to corresponding portions of the exposed substantially continuous thin lengthwise strip portions 29 of the first surface 27 of the second film 26 that show between adjacent spaced apart filament bundles 21 of the second array 24.

Step J of the method includes, substantially simultaneously with the anchoring, bonding or otherwise adhering at least a portion of the exposed surfaces 20 of the filament bundles 11 of the first array 14 to corresponding portions of the exposed substantially continuous thin lengthwise strip portions 29 of the first surface 27 of the second film 26, anchoring, bonding or otherwise adhering at least a portion of the exposed surfaces 30 of the filament bundles 21 of the second array 24 to corresponding portions of the exposed substantially continuous thin lengthwise strip portions 19 of the first surface 17 of the first film 16 that show between adjacent spaced apart filament bundles 11 of the first array 14.

Optionally, the anchoring, bonding or otherwise adhering of step J of the method includes applying heat, applying pressure, or applying a combination thereof. For example, applying heat, applying pressure, or applying a combination thereof is particularly effective in operating the anchoring, bonding or otherwise adhering of step J of the method when the first and second films 16, 26 are thermoplastic or other polymeric films, and the coupling agent 32 is a compatible polymeric material. By example and without limitation, step J of the method includes passing the combination of the first and second arrays 14, 24 of fiber bundles 11, 21 and the first and second films 16, 26 into an oven 35 to provide the anchoring, bonding or otherwise adhering of step J between the first and second fiber bundles 11, 21 and the deposits 31, 33 of coupling agent 32, as well as between the first and second films 16, 26 and the deposits 31, 33 of coupling agent 32.

Alternatively, the coupling agent 32 is a polymeric latex deposited onto the exposed surfaces 20 of the filament bundles 11 of the first array 14 and onto the exposed substantially continuous thin lengthwise strip portions 19 of the first surface 17 of the corresponding first film 16, and subsequently bonded thereto with heat and/or pressure. The interlineated fiber bundles 11, 21 between the first and second films 16, 26 are passed into the nip between pressure rolls 36. The interlineated fiber bundles 11, 21, with the attached films 16, 26 may then be heated, if desired.

In another alternative, the anchoring, bonding or otherwise adhering of step J of the method includes passing the interlineated fiber bundles 11, 21, with the attached films 16, 26 between a pre-lamination roller 37 and a heated platen 38. The heated platen 38 supports the fiber bundles 11, 21 and the films 16, 26 against pressure exerted by the pre-lamination roller 36. After heating, the fiber bundles 11, 21 and the attached films 16, 26 are laminated by passing them through a pair of heated nip rolls 20, 21 to supply proper laminating forces.

The anchoring, bonding or otherwise adhering of step J of the method may also include applying heat, applying pressure, or applying a combination thereof when the coupling agent 32 is an adhesive of a type which curing thereof is promoted by heat, pressure, or a combination thereof.

The assembled ballistic-resistant laminate structure 10 is then wound onto a take-up beam 39. Alternatively, curing of the coupling agent 32 takes place after the interlineated fiber bundles 11, 21 and the attached films 16, 26 are wound onto the take-up beam 39. For example, when the coupling agent 32 is an aerobic or air-curing adhesive.

FIG. 2 is a plan view of the ballistic-resistant laminate structure 10 that illustrates by example and without limitation the method for making the same. This view more clearly illustrates the substantially uniform and continuous spacings 18 between adjacent filament bundles 11 that expose the substantially continuous thin lengthwise portions 19 of the first surface 17 of the first film 16 that show between adjacent spaced apart filament bundles 11. This view of the ballistic-resistant laminate structure 10 also illustrates the substantially continuous deposits 31 of the coupling agent 32 deposited onto the exposed surfaces 20 of the filament bundles 11 of the first array 14 that face away from the first film 16. Here, the interlineations are illustrated of the spaced apart filament bundles 11 of the first array 14 with the spaced apart filament bundles 21 of the second array 24.

FIG. 3 is a pictorial view of the ballistic-resistant laminate structure 10 that illustrates by example and without limitation the method for making the same. This view also more clearly illustrates the substantially uniform and continuous spacings 18 between adjacent filament bundles 11 that expose the substantially continuous thin lengthwise portions 19 of the first surface 17 of the first film 16 that show between adjacent spaced apart filament bundles 11. This view of the ballistic-resistant laminate structure 10 also illustrates the substantially continuous deposits 31 of the coupling agent 32 deposited onto the exposed surfaces 20 of the filament bundles 11 of the first array 14 that face away from the first film 16. This Figure also illustrates the substantially continuous deposits 33 of the coupling agent 32 deposited onto the exposed substantially continuous thin lengthwise portions 19 of the first surface 17 of the first film 16 that show in the substantially uniform and continuous spacings 18 between adjacent spaced apart filament bundles 11.

Also illustrated are the interlineations of the spaced apart filament bundles 11 of the first array 14 with the spaced apart filament bundles 21 of the second array 24.

Figure 4:
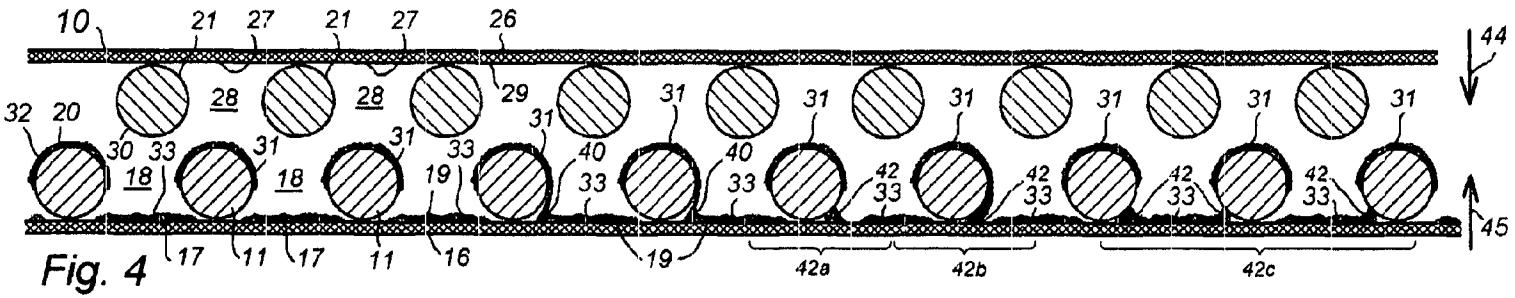
FIG. 4 is a close-up cross-section view that illustrates one stage in an exemplary novel method for making the novel ballistic-resistant laminate structure.

FIG. 4 is a close-up cross-section view that illustrates a stage in the method for making the ballistic-resistant laminate structure 10. Here, the step A of forming the first or "left" plurality of bundles 11 of twisted or untwisted high strength filaments or fibers is already accomplished. The step B of passing the first single layer array 14 of filament bundles 11 over the first or "left" film application roller or mandrel 15 and applying the thin and flexible first or "left" film 16 is also accomplished. This Figure illustrates the first surface 17 of the first film 16 being arranged in close proximity to the filament bundles 11 of the first array 14, and further illustrates the arrangement of the filament bundles 11 on the first surface 17 of the first film 16 for forming the substantially uniform and continuous spacings 18 between adjacent filament bundles 11, whereby the substantially continuous thin lengthwise portions 19 of the first surface 17 of the first film 16 are exposed as thin strips of the first surface 17 that show between adjacent spaced apart filament bundles 11.

Here, also, the depositing step E of the method is accomplished, whereby the substantially continuous deposits 31 of an coupling agent 32 are deposited onto the exposed surfaces 20 of the filament bundles 11 of the first array 14 that face away from the first film 16. Furthermore, the substantially continuous deposits 33 of the coupling agent 32 are deposited onto the exposed substantially continuous thin lengthwise strip portions 19 of the first surface 17 of the corresponding first film 16 that show between the adjacent fiber bundles 11 of the first array 14.

As illustrated here, the depositing step E of the method may include continuous or intermittent portions 40 of the coupling agent 32 interconnecting the substantially continuous deposits 31 of the coupling agent 32 that is intentionally or inadvertently leaked or otherwise deposited on the exposed surfaces 20 of the filament bundles 11 of the first array 14 with the adjacent substantially continuous deposits 33 of the coupling agent 32 deposited on the exposed substantially continuous thin lengthwise strip portions 19 of the first surface 17 of the corresponding first film 16 that show between the adjacent fiber bundles 11 of the first array 14. When the coupling agent 32 is deposited by spraying, the interconnecting leakage portions 40 of coupling agent 32 is leaked or otherwise deposited by overspray. When the coupling agent 32 is deposited by painting or other liquid application method, the interconnecting leakage portions 40 of coupling agent 32 is leaked or otherwise deposited, for example by splash, spill, drip or trailing. Accordingly, whether intentional or inadvertent, the interconnecting leakage portions 40 of coupling agent 32 is expected to be intermittent between the substantially continuous deposits 31 of the coupling agent 32 deposited on the exposed surfaces 20 of the filament bundles 11 and the adjacent substantially continuous deposits 33 on the exposed substantially continuous thin lengthwise strip portions 19 of the first surface 17 of the corresponding first film 16. By example and without limitation, the interconnecting leakage portions 40 of coupling agent 32 is intentionally applied by directing the spraying or painting applicator apparatus 34 at an appropriate slight angle to the first surface 17 of the corresponding first film 16. However, even without intentionally angling the applicator apparatus 34 relative to the film surface 17, the natural tendency of both brush bristles and spray jets is to be angularly deflected away from higher surfaces or the surfaces first encountered in a multi-surfaced object, such as the filament bundles 11 adjacent to the film surface 17. Thus, virtually any method for applying the deposits 31, 33 of the coupling agent 32 is expected to result in leaking or otherwise depositing of a plurality of the interconnecting leakage portions 40 of coupling agent 32.

Thereafter, the anchoring, bonding or otherwise adhering step J of the method includes anchoring, bonding or otherwise adhering either continuous or at least intermittent portions of the filament bundles 11 of the first array 14 to the first surface 17 of the corresponding first film 16.

As also illustrated here, the depositing step E of the method may intentionally or inadvertently include interconnecting continuous or intermittent leakage portions 42 of the coupling agent 32 directly between the filament bundles 11 of the first array 14 and portions of the adjacent exposed substantially continuous thin lengthwise strip portions 19 of the first surface 17 of the corresponding first film 16. In other words, as illustrated in the first sample 42*a* the continuous or intermittent interconnecting leakage portions 42 of the coupling agent 32 may not actually connect with either of the substantially continuous deposits 31 of the coupling agent 32 deposited on the exposed surfaces 20 of the filament bundles 11, nor with the adjacent substantially continuous deposits 33 of the coupling agent 32 leaked or otherwise deposited on the exposed substantially continuous thin lengthwise strip portions 19 of the first surface 17 of the first film 16.

Alternatively, as illustrated in the second sample 42*b* the continuous or intermittent interconnecting leakage portions 42 of the coupling agent 32 may actually connect with the substantially continuous deposits 31 of the coupling agent 32 deposited on the exposed surfaces 20 of the filament bundles 11.

Alternatively, as illustrated in the third sample 42*c* the continuous or intermittent interconnecting leakage portions 42 of the coupling agent 32 may actually connect with the adjacent substantially continuous deposits 33 of the coupling agent 32 deposited on the exposed substantially continuous thin lengthwise strip portions 19 of the first surface 17 of the first film 16.

Whether intentionally or inadvertently applied, the interconnecting portions 42 may be applied in the manner discussed herein above for the interconnecting portions 40 of coupling agent 32.

As also illustrated here, the step C of forming a second or "right" plurality of bundles 21 of twisted or untwisted high strength filaments or fibers is also already accomplished here. The step D of passing the second single layer array 24 of filament bundles 21 over the second or "right" film application roller or mandrel 25 and applying a thin and flexible second or "right" film 26 is also accomplished. The first surface 27 of the second film 26 is illustrated as being arranged in close proximity to the filament bundles 21 of the first array 24, and further the arrangement of the filament bundles 21 on the first surface 27 of the second film 26 is illustrated for forming the substantially uniform and continuous spacings 28 between adjacent filament bundles 21, whereby the substantially continuous thin lengthwise portions 29 of the first surface 27 of the second film 26 are exposed as thin strips of the first surface 27 that show between adjacent spaced apart filament bundles 21.

As also illustrated here, the step F of interlaying the spaced apart filament bundles 11 of the first array 14 with the spaced apart filament bundles 21 of the second array 24 is indicated by the arrows 44 and 45.

Accordingly, the anchoring, bonding or otherwise adhering step J of the method includes anchoring, bonding or otherwise adhering at least a portion of the exposed surfaces 20 of the filament bundles 11 of the first array 14 to corresponding portions of the exposed substantially continuous thin lengthwise strip portions 29 of the first surface 27 of the second film 26 that show between adjacent spaced apart filament bundles 21 of the second array 24.

Figure 5:
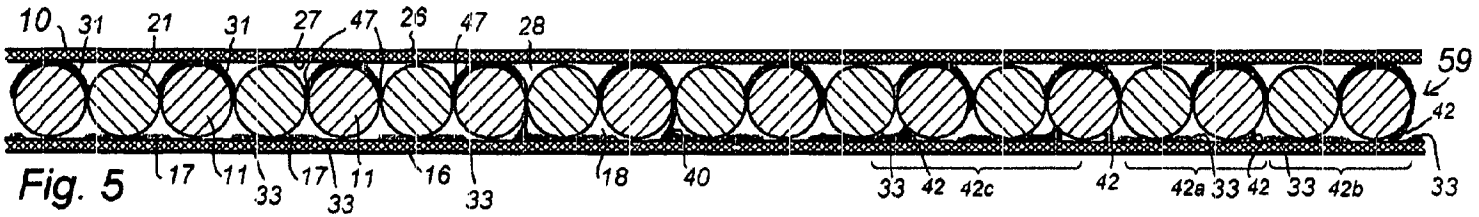
FIG. 5 is a close-up cross-section view that illustrates one exemplary view of the novel ballistic-resistant laminate structure that illustrates by example and without limitation spaced apart filament bundles of a first array interlaid with the spaced apart filament bundles of a second array.

FIG. 5 is a cross-section view that illustrates the spaced apart filament bundles 11 of the first array 14 interlaid with the spaced apart filament bundles 21 of the second array 24. As illustrated here, the portion of step G of contacting the substantially continuous deposits 31 of the coupling agent 32 deposited on the exposed surfaces 20 of the filament bundles 11 of the first array 14 with the exposed substantially continuous thin lengthwise strip portions 29 of the first surface 27 of the second film 26 that show between adjacent spaced apart filament bundles 21 of the second array 24 is already accomplished. Also already accomplished is the portion of step G of contacting the exposed surfaces 30 of the filament bundles 21 of the second array 24 facing away from the first surface 27 of the second film 26 with the substantially continuous deposits 33 of the coupling agent 32 deposited on the exposed substantially continuous thin lengthwise strip portions 19 of the first surface 17 of the first film 16 that show between the adjacent fiber bundles 11 of the first array 14.

As also illustrated here, the contacting step G of the method may intentionally or inadvertently include interconnecting a continuous or intermittent portions 47 of the coupling agent 32 directly between the filament bundles 11 of the first array 14 directly and a portion of the adjacent exposed surfaces 30 of the filament bundles 21 of the second array 24. By example and without limitation, the interconnecting portions 47 is applied by transferring a portion of the substantially continuous deposits 31 of the coupling agent 32 deposited on the exposed surfaces 20 of the filament bundles 11 of the first array 14 directly to the adjacent filament bundles 21 of the second array 24 substantially simultaneously with being laid into the gaps 18 therebetween, as indicated by the arrows 44, 45 in FIG. 4.

Whether intentionally or inadvertently applied, the interconnecting transfer portions 47 may be applied in the manner discussed herein above for the interconnecting portions 40 and 42 of coupling agent 32.

Thereafter, the anchoring, bonding or otherwise adhering step J of the method includes anchoring, bonding or otherwise adhering either continuous or at least intermittent portions of the filament bundles 11 of the first array 14 at least intermittently to the continuous or at least intermittent portions of the filament bundles 21 of the second array 24.

The method includes a step J of anchoring, bonding or otherwise adhering at least a portion of the exposed surfaces 20 of the filament bundles 11 of the first array 14 to corresponding portions of the exposed substantially continuous thin lengthwise strip portions 29 of the first surface 27 of the second film 26 that show between adjacent spaced apart filament bundles 21 of the second array 24.

Figure 6:
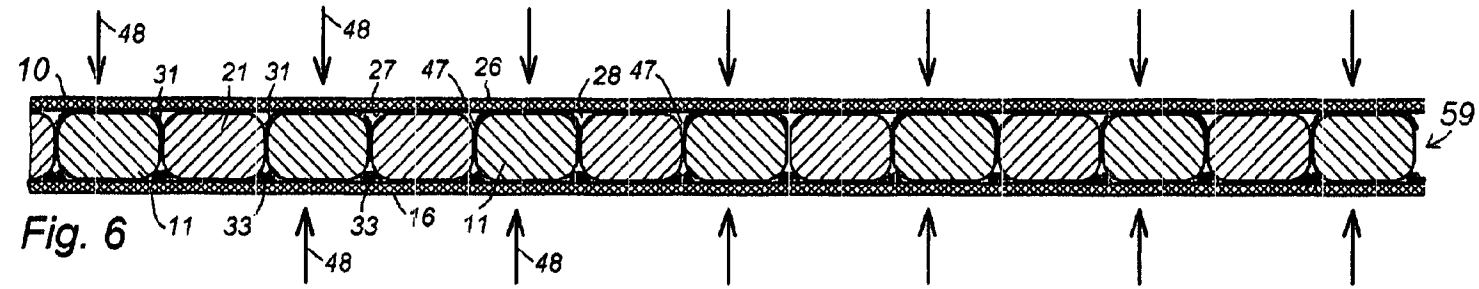
FIG. 6 is a close-up cross-section view that illustrates the filament bundles of the first and second arrays being compressed between first and second films.

FIG. 6 is a cross-section view that illustrates the filament bundles 11 and 21 of the first and second arrays 14 and 24 being compressed between the first and second films 16, 26. Accordingly, the filament bundles 11, 21 are formed into flatter and more square or oblong shapes from the generally round or cylindrical shapes illustrated in earlier Figures. Such forming of the filament bundles 11, 21 into flatter and squarer shapes is accomplished, for example, in the optional stage of step G of the method wherein the first and second application rollers or mandrels 15 and 25 are operated in a known manner for applying pressure for compressing therebetween the first and second arrays 14 and 24 of fiber bundles 11 and 21 onto the first and second films 16 and 26, as indicated by arrows 48. Accordingly, the interlineated fiber bundles 11 and 21 are flattened and spread across the first surfaces 17 and 27 of the respective first and second films 16 and 26.

Figure 7:
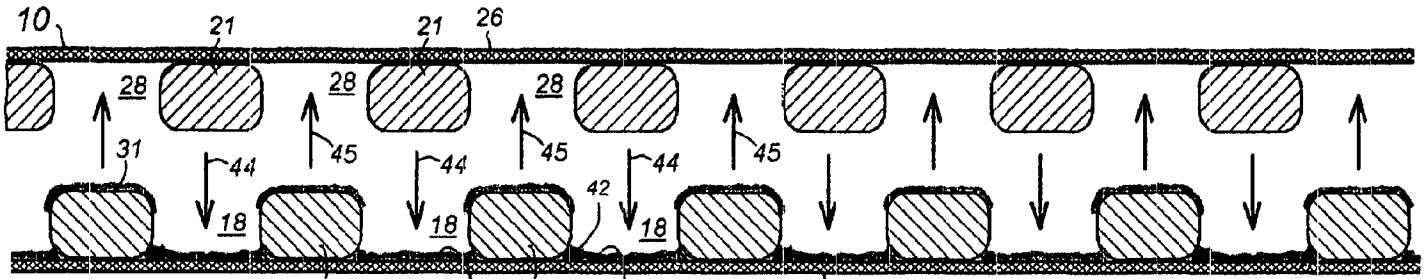
FIG. 7 is a close-up cross-section view that illustrates the filament bundles of the first and second arrays being compressed before an interlaying step of one exemplary novel method for making the ballistic-resistant laminate structure wherein the spaced apart filament bundles of the first array are interlaid with the spaced apart filament bundles of the second array.

FIG. 7 is a cross-section view that illustrates the filament bundles 11 and 21 of the first and second arrays 14 and 24 being compressed before the interlaying of step F wherein the spaced apart filament bundles 11 of the first array 14 are interlaid with the spaced apart filament bundles 21 of the second array 24, as indicated by the arrows 44 and 45. After the subsequent interlaying of step F is accomplished, the ballistic-resistant laminate structure 10 appears approximately as illustrated in FIG. 6. Here, the filament bundles 11 of the first array 14 are anchored, bonded or otherwise adhered directly to the first surface 17 of the first film 16 by the interconnecting continuous or intermittent leakage portions 42 of the coupling agent 32 intentionally or inadvertently leaked between the filament bundles 11 of the first array 14 and portions of the adjacent exposed substantially continuous thin lengthwise strip portions 19 of the first surface 17 of the corresponding first film 16.

The filament bundles 21 of the second array 24 are interlaid between the filament bundles 11 of the first array 14, whereupon continuous or intermittent portions 47 of the coupling agent 32 are intentionally or inadvertently transferred directly between the filament bundles 11 of the first array 14 and portions of the adjacent exposed surfaces 30 of the filament bundles 21 of the second array 24.

After interlaying of the filament bundles 11 and 21 of the first and second arrays 14 and 24, the anchoring, bonding or otherwise adhering step J is accomplished to result in the ballistic-resistant laminate structure 10 approximately as illustrated in FIG. 6.

Figures 8, 9, 10, 11, 12, 13, 15, 16:
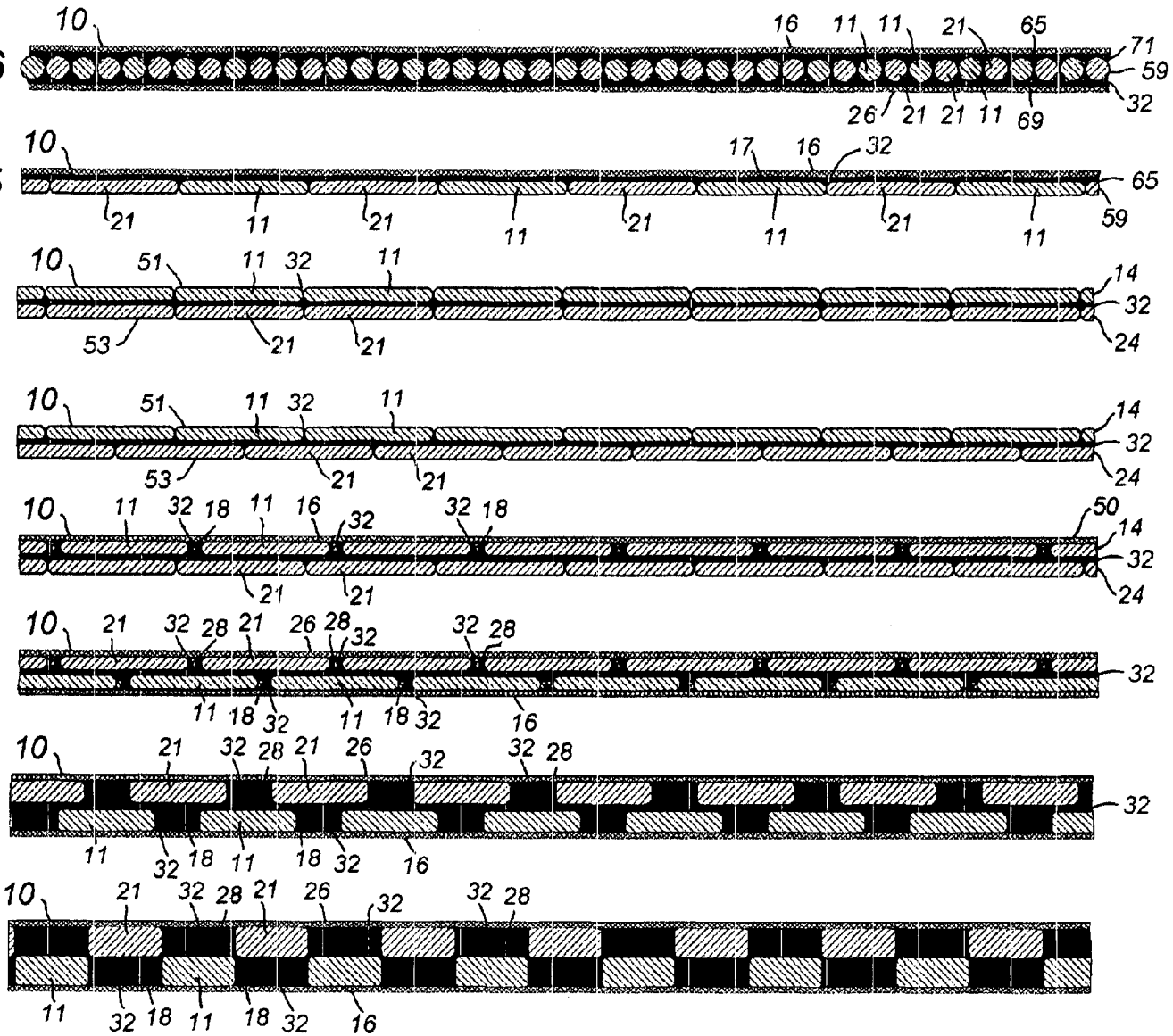
FIG. 8 is a close-up cross-section view that illustrates one alternative to the novel ballistic-resistant laminate structure illustrated in FIG. 6.
FIG. 9 and FIG. 10 are close-up cross-section views that illustrate respective additional alternative configurations of the novel ballistic-resistant laminate structure.
FIG. 11 is a close-up cross-section view that illustrates another additional alternative configuration of the novel ballistic-resistant laminate structure in which the second layered array of filament bundles overlaps the first array of filament bundles in the overlapping or "brick" pattern.
FIG. 12 is a close-up cross-section view that illustrates another additional alternative configuration of the novel ballistic-resistant laminate structure in which the second layered array of filament bundles again overlaps the first array of filament bundles.
FIG. 13 is a close-up cross-section view that illustrates another additional alternative configuration of the novel ballistic-resistant laminate structure in which both first and second filament bundles are further parallelized and closely packed into the respective first and second arrays.
FIG. 15 is a close-up cross-section view that illustrates another embodiment of the novel ballistic-resistant laminate structure wherein a step of the method is optionally accomplished for anchoring, bonding or otherwise adhering at least a portion of the first surfaces of the filament bundles of the closely packed array to corresponding portions of the first surface of the first film.
FIG. 16 is a close-up cross-section view that illustrates another embodiment of the novel ballistic-resistant laminate structure wherein substantially continuous deposits of a coupling agent are alternatively deposited onto the exposed second surfaces of the filament bundles using an appropriate applicator.

FIG. 8 is a cross-section view that illustrates one alternative to the ballistic-resistant laminate structure 10 illustrated in FIG. 6. Here, the filament bundles 11 and 21 of the first and second arrays 14 and 24 are not compressed together. Rather, sufficient quantities of the coupling agent 32 are deposited in the substantially uniform and continuous spacings 18 and 28 between adjacent filament bundles 11 and 21 of the respective opposing first and second arrays 14 and 24. The ballistic-resistant laminate structure 10 illustrated here results when the coupling agent 32 is fixed during step J.

FIG. 9 and FIG. 10 are cross-section views that illustrate respective additional alternative configurations of the ballistic-resistant laminate structure 10. In each of FIGS. 9 and 10 the filament bundles 11 and 21 of the first and second arrays 14 and 24 are flattened and laid one over the other in an overlapping or "brick" pattern with the coupling agent 32 therebetween for connecting them together. The first and second films 16 and 26 are overlaid outside the arrays 14, 24 of filament bundles 11, 21.

Continuous or intermittent interconnecting portions 42 of the coupling agent 32 fix the filament bundles 11, 21 to the respective films 16, 26. By example and without limitation, the interconnecting portions 42 of the coupling agent 32 are exuded between the filament bundles 11, 21 by passage between the application rollers or mandrels 15, 25 during application of the first and second films 16, 26, which may also result in the flattening of the filament bundles 11, 21.

FIG. 11 is a cross-section view that illustrates another additional alternative configuration of the ballistic-resistant laminate structure 10 in which the second layered array 24 of filament bundles 21 again overlaps the first array 14 of filament bundles 11 in the overlapping or "brick" pattern with the coupling agent 32 therebetween. Additionally, here the filament bundles 21 are further parallelized and closely packed into the overlaying array 24. The filament bundles 21 of the closely packed overlaying array 24 effectively capture and confine the deposited coupling agent 32 therebetween. The close packing of filament bundles 21 of the overlaying array 24 obviate the need for the second film 26 illustrated in previous configurations. Rather, the ballistic-resistant laminate structure 10 can be safely wound onto the take-up beam 39 without the coupling agent 32 contacting or coupling to an outer surface 50 of the first film 16 exposed opposite from its first surface 17 and the arrays 14, 24 of filament bundles 11, 21 coupled thereto. Accordingly, only the single first film 16 is anchored, bonded or otherwise adhered to the first array 14 of filament bundles 11, while the second film 26 is optionally omitted.

FIG. 12 is a cross-section view that illustrates another additional alternative configuration of the ballistic-resistant laminate structure 10 in which the second layered array 24 of filament bundles 21 again overlaps the first array 14 of filament bundles 11 with the coupling agent 32 therebetween. Additionally, here both filament bundles 11 and 21 are further parallelized and closely packed into the arrays 14 and 24. The filament bundles 21 of the closely packed arrays 14 and 24 effectively capture and confine the deposited coupling agent 32 between them. The close packing of filament bundles 11 and 21 of the two arrays 14 and 24 obviate the need for either the first film 16 or the second film 26 illustrated in previous configurations. Rather, the ballistic-resistant laminate structure 10 can be safely wound onto the take-up beam 39 without the coupling agent 32 contacting or coupling to outer surfaces 51 and 53 of the respective filament bundles 11 and 21 of the arrays 14 and 24. Accordingly, one or both of the first and second films 16 and 26 is optionally omitted.

FIG. 13 is a cross-section view that illustrates another additional alternative configuration of the ballistic-resistant laminate structure 10 in which both filament bundles 11 and 21 are further parallelized and closely packed into the arrays 14 and 24. However, here the filament bundles 11 and 21 of the first and second arrays 14 and 24 are substantially aligned with the coupling agent 32 therebetween. The filament bundles 21 of the closely packed arrays 14 and 24 effectively capture and confine the deposited coupling agent 32 between them. The close packing of filament bundles 11 and 21 of the two arrays 14 and 24 obviate the need for either the first film 16 or the second film 26 illustrated in previous configurations. Rather, the ballistic-resistant laminate structure 10 can be safely wound onto the take-up beam 39 without the coupling agent 32 contacting or coupling to the outer surfaces 51 and 53 of the respective filament bundles 11 and 21 of the arrays 14 and 24. Accordingly, one or both of the first and second films 16 and 26 is optionally omitted.

Figure 14:
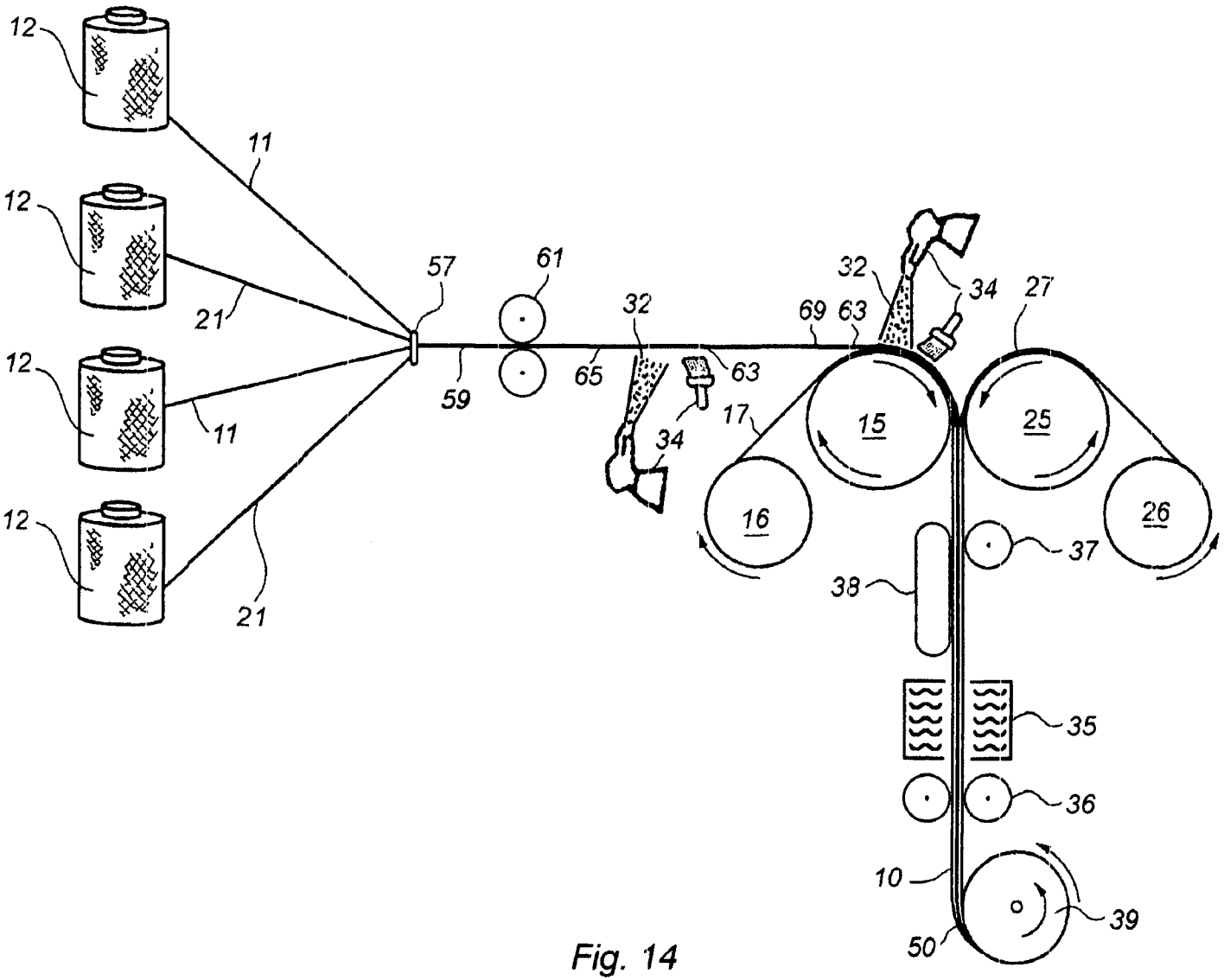
FIG. 14 illustrates another exemplary novel method for making the novel ballistic-resistant laminate structure resulting in an alternative embodiment of the novel ballistic-resistant laminate structure wherein a plurality of bundles of the twisted or untwisted high strength filaments or fibers are unidirectional, and the bundles are passed through a comb guide where the plurality of filament bundles are further parallelized and arrayed into a single closely packed array formed of a single layer having a predetermined uniform number of filament bundles per inch of width.

FIG. 14 illustrates another exemplary method for making the ballistic-resistant laminate structure 10 wherein a plurality of the bundles 11, 21 of twisted or untwisted high strength filaments or fibers are unidirectional, and the bundles are passed through a comb guide 57 where the plurality of adjacent alternating filament bundles 11, 21 are further parallelized and arrayed into a single closely packed array 59 formed of a single layer having a predetermined uniform number of filament bundles per inch of width, for example using conventional equipment 61 and techniques well known in the industry as set forth in the prior art.

Substantially continuous deposits 63 of the coupling agent 32 of the type described herein are deposited onto exposed first surfaces 65 of the filament bundles 11, 21 using appropriate applicator equipment 34.

The filament bundles 11, 21 of the closely packed array 59 are passed over the first or "left" film application roller or mandrel 15 where the first or "left" film 16 of thin and flexible polyethylene or other suitable material is applied to the closely packed array 59 of filament bundles.

As in step B, above, application of the first film 16 to the closely packed array 59 of filament bundles causes the first surface 17 of the first film 16 to be arranged in close proximity to the filament bundles 11, 21 of the closely packed array 59 with the substantially continuous deposits 63 of the coupling agent 32 deposited therebetween. Second surfaces 69 of the filament bundles 11, 21 of the closely packed array 59 opposite from the first surfaces 65 thereof and facing away from the first surface 17 of the first film 16 remain exposed.

FIG. 15 is a cross-section view that illustrates another embodiment of the ballistic-resistant laminate structure 10 wherein step J of the method is optionally accomplished for anchoring, bonding or otherwise adhering at least a portion of the first surfaces 65 of the filament bundles 11, 21 of the closely packed array 59 to corresponding portions of the first surface 17 of the first film 16 using the coupling agent 32.

FIG. 16 is a cross-section view that illustrates another embodiment of the ballistic-resistant laminate structure 10 wherein, in addition to the substantially continuous deposits 63 of the coupling agent 32 of the type described herein are deposited onto at least a portion of the first surfaces 65 of the filament bundles 11, 21, substantially continuous deposits 71 of the coupling agent 32 are alternatively deposited onto the exposed second surfaces 69 of the filament bundles 11, 21 using appropriate applicator equipment or apparatus 34. Thereafter, the filament bundles 11, 21 of the closely packed array 59 are passed over the second or "right" film application roller or mandrel 25 where the second or "right" 26 of thin and flexible polyethylene or other suitable material is applied to the second surfaces 69 of the closely packed array 59 of filament bundles.

Figure 17:
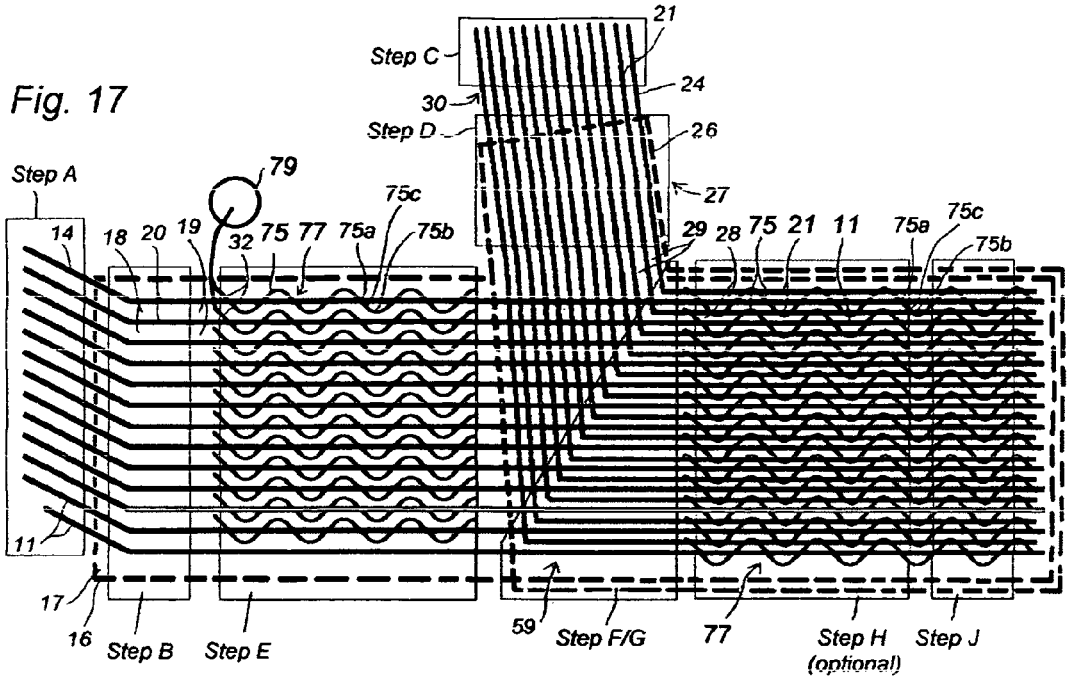
FIG. 17 illustrates another exemplary novel method for making the novel ballistic-resistant laminate structure resulting in an alternative embodiment of the novel ballistic-resistant laminate structure.

FIG. 17 illustrates an alternative embodiment of step E of the method for making the ballistic-resistant laminate structure 10 wherein substantially continuous deposits or "beads" 75 of the coupling agent 32 are provided in substantially continuous individual deposit patterns 77. As more clearly illustrated in FIG. 18, the substantially continuous individual deposit patterns 77 include both substantially continuous deposit portions 75*a* on the exposed surfaces 20 of the filament bundles 11 of the first array 14, and substantially continuous deposit portions 75*b* on the exposed substantially continuous thin lengthwise strip portions 19 of the first surface 17 of the first film 16 that show between the adjacent fiber bundles 11. Additionally, the substantially continuous deposits 75 of the coupling agent 32 includes substantially continuous deposit portions 75*c* of the coupling agent 32 that interconnect the deposit portions 75*a* on the exposed surfaces 20 of the filament bundles 11 of the first array 14, and the deposit portions 75*b* on the exposed substantially continuous thin lengthwise strip portions 19 of the first surface 17 of the first film 16. Accordingly, the substantially continuous deposits 75 include: the filament bundle deposit portions 75*a*, the film surface deposit portions 75*b*, and the interconnect deposit portions 75*c* therebetween in a substantially continuous deposit or "bead" of the coupling agent 32 along the individual filament bundles 11 of the first array 14, or alternatively along the individual filament bundles 21 of the second array 24. The respective filament bundle deposit portions 75*a*, the film surface deposit portions 75*b*, and the interconnect deposit portions 75*c* of the substantially continuous deposits 75 the coupling agent 32 are substantially simultaneously deposited onto the exposed surfaces 20 of the individual filament bundles 11 of the first or "left" array 14, onto the substantially continuous thin lengthwise portions or "strips" 19 of the first surface 17 of the film 16 that show in the substantially uniform and continuous spacings 18 between adjacent spaced apart filament bundles 11, and further interconnecting therebetween. Here, the substantially continuous individual deposit patterns 77 of the deposits 75 of the coupling agent 32 are substantially continuous meltblown serpentine "omega" patterns that are deposited using a bead-type applicator apparatus 79. By example and without limitation, the applicator apparatus 79 for depositing the individual patterns 77 of the deposits 75 of the coupling agent 32 is a patented applicator apparatus of the type disclosed in U.S. Pat. No. 5,902,540, "Meltblowing Method And Apparatus" issued May 11, 1999, U.S. Pat. No. 5,882,573, "Adhesive Dispensing Nozzles For Producing Partial Spray Patterns And Method Therefor" issued Mar. 16, 1999, and U.S. Pat. No. 5,904,298, "Meltblowing Method And System" issued May 18, 1999, all to Kwok and which all teach a meltblowing method and apparatus for dispensing an adhesive, including fiberized hot melt adhesive, which are all incorporated herein by reference, which machine is available from ITW Dynatec, Hendersonville, Tenn., 37075, USA. Alternatively, the substantially continuous deposits 75 of the coupling agent 32 are substantially simultaneously deposited onto both the exposed surfaces 20 of the individual filament bundles 11 of the first array 14 and the substantially continuous thin lengthwise portions 19 of the first surface 17 of the film 16 in another suitable substantially continuous individual deposit patterns 77 using the same or an alternative applicator apparatus 79 such as is now or may become available at a later time.

Thereafter, the interlaying step F of the method is performed, wherein the spaced apart filament bundles 11 of the first array 14 are interlaid with the spaced apart filament bundles 21 of the second array 24. Accordingly, the adjacent spaced apart filament bundles 11 of the first array 14 are laid into the substantially continuous spacings or gaps 28 between the adjacent spaced apart filament bundles 21 of the second array 24, and the adjacent spaced apart filament bundles 21 of the second array 14 are substantially simultaneously laid into substantially continuous spacings or gaps 18 between the adjacent spaced apart filament bundles 11 of the first array 14.

The contacting step G of the method contacts the substantially continuous deposit portions 75*a* of the coupling agent 32 deposited on the exposed surfaces 20 of the filament bundles 11 of the first array 14 with the exposed substantially continuous thin lengthwise strip portions 29 of the first surface 27 of the second film 26 that show between adjacent spaced apart filament bundles 21 of the second array 24. Substantially simultaneously therewith, the exposed surfaces 30 of the filament bundles 21 of the second array 24 contact with the substantially continuous deposit portions 75*b* of the coupling agent 32 deposited on the exposed substantially continuous thin lengthwise strip portions 19 of the first surface 17 of the first film 16 between the adjacent fiber bundles 11 of the first array 14. Further substantially simultaneously therewith, the interconnect deposit portions 75*c* of the substantially continuous deposits 75 substantially simultaneously interconnect the deposit portions 75*a* and 75*b* of the coupling agent 32.

If the step D of the method for applying the second film 26 to the second array 24 of filament bundles 21 is omitted, the application step H of the method may be included for applying the second film 26 to the second array 24 of filament bundles 21 at a later stage after accomplishment of the interlaying step F.

Regardless of how the substantially continuous individual deposit patterns 77 of the of the coupling agent 32 are applied, the deposit portions 75*a* of the substantially continuous deposits 75 of coupling agent 32 intermittently couple the individual filament bundles 11 of the first array 14 to the substantially continuous thin lengthwise strip portions 29 of the first surface 27 of the second film 26 that show in the substantially uniform and continuous spacings 28 between adjacent spaced apart filament bundles 21 of the second array 24, and the substantially continuous deposit portions 75*b* of the coupling agent 32 intermittently couple the individual filament bundles 21 of the second array 24 to the substantially continuous thin lengthwise portions 19 of the surface 17 of the first film 16 that show in the substantially uniform and continuous spacings 18 between adjacent spaced apart filament bundles 11 of the first array 14. Furthermore, as more clearly shown in FIGS. 18 and 19, when the filament bundles 11 of the first array 14 and the filament bundles 21 of the second array 24 are interlaid one with the other, the substantially continuous interconnecting deposit portions 75*c* of the coupling agent 32 couple directly between the filament bundles 11 of the first array 14 directly and a portion of the adjacent exposed surfaces 30 of the filament bundles 21 of the second array 24 by transferring a portion of the substantially continuous interconnecting deposit portions 75*c* of the coupling agent 32 deposited on the exposed surfaces 20 of the filament bundles 11 of the first array 14 directly to the adjacent filament bundles 21 of the second array 24 substantially simultaneously with being laid into the gaps 18 therebetween, as indicated by the arrows 44, 45 in FIG. 18.

The anchoring, bonding or otherwise adhering of step J of the method results in the laminate structure 10 as disclosed herein.

Figure 18:
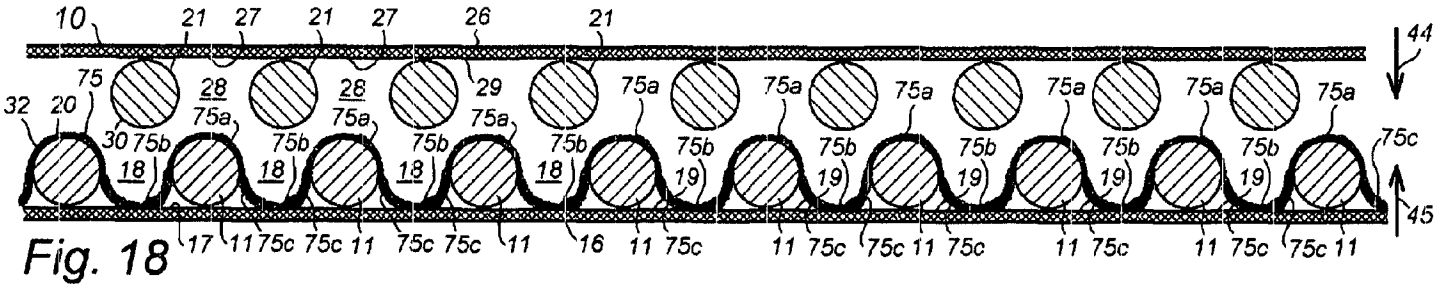
FIG. 18 is a close-up cross-section view that illustrates a stage in the novel method for making the novel ballistic-resistant laminate structure according to the exemplary alternative embodiment of a novel step of the method for depositing substantially continuous deposits or "beads" of a coupling agent as illustrated by example and without limitation in FIG. 17.

FIG. 18 is a close-up cross-section view that illustrates a stage in the method for making the ballistic-resistant laminate structure 10 according to the alternative embodiment of step E of the method for depositing substantially continuous deposits or "beads" 75 of the coupling agent 32, as illustrated by example and without limitation in FIG. 17. Accordingly, the substantially continuous deposits or "beads" 75 of the coupling agent 32 are illustrated as being applied in the substantially continuous individual deposit patterns 77 that includes deposit portions 75*a* on the exposed surfaces 20 of the filament bundles 11 of the first array 14, deposit portions 75*b* on the exposed substantially continuous thin lengthwise strip portions 19 of the first surface 17 of the first film 16 that show between the adjacent fiber bundles 11, and the substantially continuous deposit portions 75*c* of the coupling agent 32 that interconnect the deposit portions 75*a* on the exposed surfaces 20 of the filament bundles 11 of the first array 14, and the deposit portions 75*b* on the exposed substantially continuous thin lengthwise strip portions 19 of the first surface 17 of the first film 16.

Figure 19:
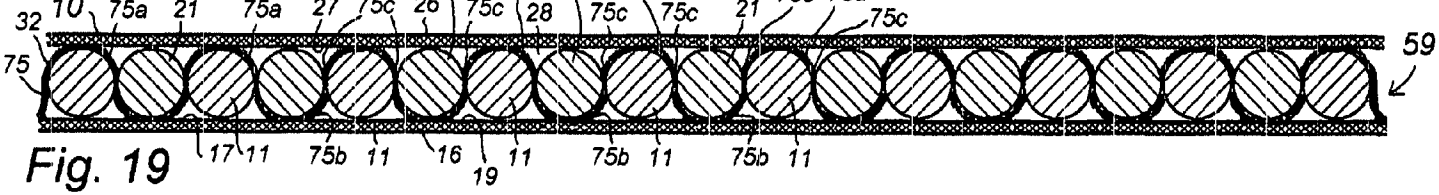
FIG. 19 is a close-up cross-section view of an exemplary novel ballistic-resistant laminate structure produced by novel step of the method for depositing substantially continuous deposits or "beads" of a coupling agent as illustrated by example and without limitation in FIG. 17.

FIG. 19 is a close-up cross-section view that illustrates the spaced apart filament bundles 11 of the first array 14 interlaid with the spaced apart filament bundles 21 of the second array 24. Here, the portion of contacting step G of the method is illustrated according to the alternative embodiment of step E of the method illustrated by example and without limitation in FIG. 17. Accordingly, the substantially continuous deposit portions 75*a* of the coupling agent 32 deposited on the exposed surfaces 20 of the filament bundles 11 of the first array 14 contact the exposed substantially continuous thin lengthwise strip portions 29 of the first surface 27 of the second film 26 that show between adjacent spaced apart filament bundles 21 of the second array 24. Substantially simultaneously therewith, the exposed surfaces 30 of the filament bundles 21 of the second array 24 contact with the substantially continuous deposit portions 75*b* of the coupling agent 32 deposited on the exposed substantially continuous thin lengthwise strip portions 19 of the first surface 17 of the first film 16 between the adjacent fiber bundles 11 of the first array 14, and further substantially simultaneously therewith, the coupling agent 32 of the interconnect deposit portions 75*c* of the substantially continuous deposits 75 substantially simultaneously interconnect the substantially continuous deposit portions 75*a* and 75*b* of the coupling agent 32.

Furthermore, the alternative embodiment of step E of the method illustrated by example and without limitation in FIG. 17 is optionally used to result in a variety of alternative configurations of the different ballistic-resistant laminate structure 10, including the different configurations disclosed, by example and without limitation, in FIGS. 8 through 13 herein.

Figure 20:
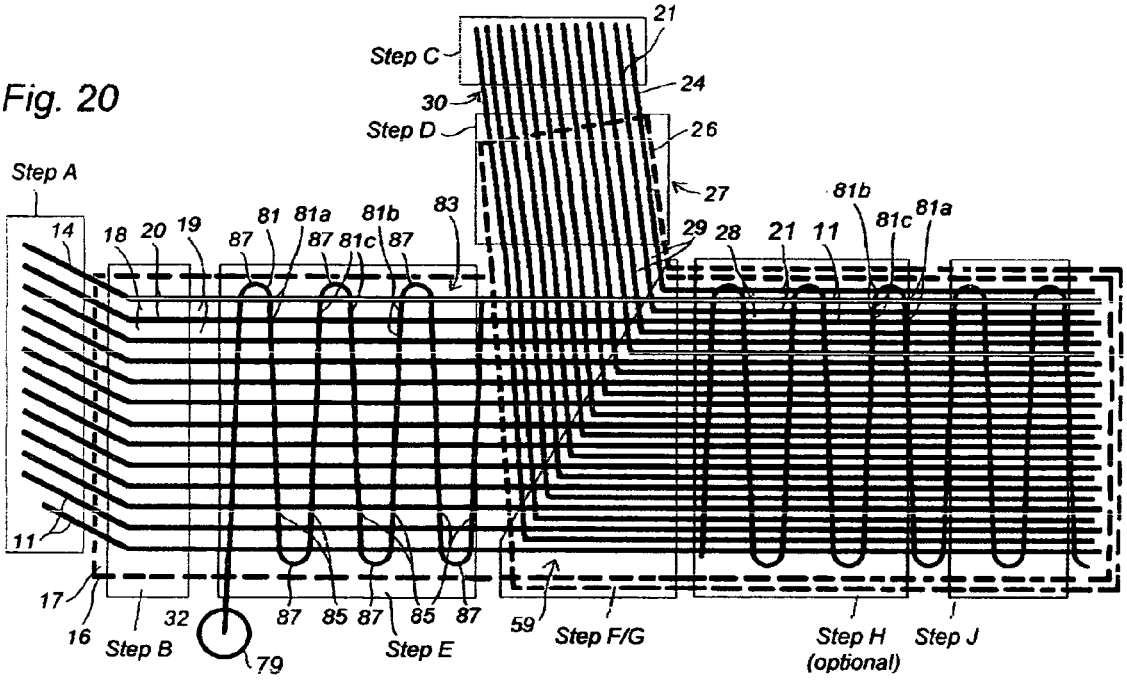
FIG. 20 illustrates another exemplary novel method for making the novel ballistic-resistant laminate structure resulting in an alternative embodiment of the novel ballistic-resistant laminate structure.

FIG. 20 illustrates another alternative embodiment of step E of the method for making the ballistic-resistant laminate structure 10 wherein a substantially continuous deposit or "bead" 81 of the coupling agent 32 is provided in a substantially continuous random deposit pattern 83 that includes deposit portions 81*a* on the exposed surfaces 20 of the filament bundles 11 of the first array 14, and deposit portions 81*b* on the exposed substantially continuous thin lengthwise strip portions 19 of the first surface 17 of the first film 16 that show between the adjacent fiber bundles 11. Additionally, the substantially continuous deposit 81 of the coupling agent 32 includes substantially continuous deposit portions 81*c* of the coupling agent 32 that interconnect the deposit portions 81*a* on the exposed surfaces 20 of the filament bundles 11 of the first array 14, and the deposit portions 81*b* on the exposed substantially continuous thin lengthwise strip portions 19 of the first surface 17 of the first film 16. Accordingly, the substantially continuous deposit 81 includes: the filament bundle deposit portions 81*a*, the film surface deposit portions 81*b*, and the interconnect deposit portions 81*c* in a substantially continuous deposit or "bead" of the coupling agent 32 across the first array 14 of the filament bundles 11. The respective filament bundle deposit portions 81*a*, the film surface deposit portions 81*b*, and the interconnect deposit portions 81*c* of the substantially continuous deposits 81 of the coupling agent 32 are substantially simultaneously deposited onto the exposed surfaces 20 of the individual filament bundles 11 of the first or "left" array 14, onto the substantially continuous thin lengthwise portions or "strips" 19 of the first surface 17 of the film 16 that show in the substantially uniform and continuous spacings 18 between adjacent spaced apart filament bundles 11, and further interconnecting therebetween. Here, the deposit pattern 83 of the deposits 81 of the coupling agent 32 are substantially continuous patterns that are deposited across the filament bundles 11 of the first array 14 using, for example, the bead-type applicator apparatus 79. Alternatively, the substantially continuous deposit 81 of coupling agent 32 is accomplished by spraying an aerosol using a spraying applicator 34, atomizing and spraying a liquid using a spraying applicator 34, wiping a gel or liquid, or painting as with a brush or other mass applicator 34.

The substantially continuous random deposit pattern 83 of the substantially continuous deposit 81 of coupling agent 32 is optionally formed in individual unconnected lines 85 of the substantially continuous deposits 81. Else, the substantially continuous random deposit pattern 83 of the substantially continuous deposit 81 of coupling agent 32 is optionally formed as a substantially continuous pattern throughout the length of the laminate structure 10. Accordingly, when the substantially continuous random deposit pattern 83 of the substantially continuous deposit 81 of coupling agent 32 is optionally formed as a substantially continuous pattern throughout at least a substantial portion of the length of the laminate structure 10, as illustrated here by example and without limitation, joining portions 87 are formed between adjacent individual and otherwise substantially unconnected lines 85 of the substantially continuous deposits 81.

Figure 21:
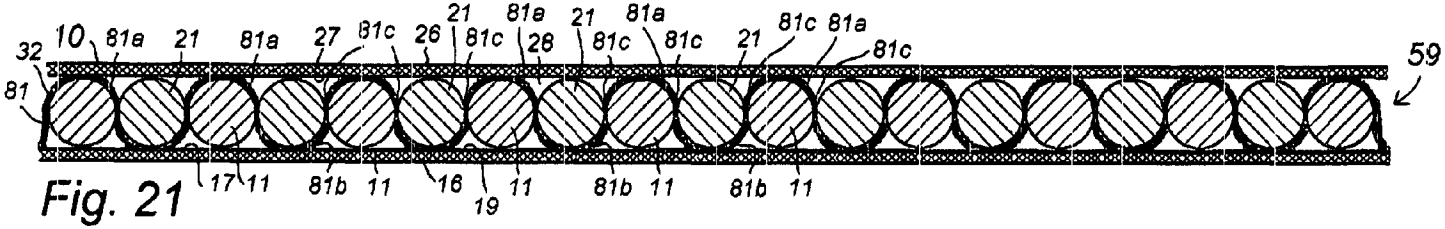
FIG. 21 is a close-up cross-section view of an exemplary novel ballistic-resistant laminate structure produced by a novel step of the method for depositing substantially continuous deposits or "beads" of a coupling agent as illustrated by example and without limitation in FIG. 20.

The alternative embodiment of step E of the method disclosed in FIG. 20 for making the ballistic-resistant laminate structure 10 produces substantially the laminate structure 10 disclosed in FIG. 21.

FIG. 21 is a cross-section view that illustrates the spaced apart filament bundles 11 of the first array 14 interlaid with the spaced apart filament bundles 21 of the second array 24. Here, the portion of contacting step G of the method is illustrated according to the alternative embodiment of step E of the method illustrated by example and without limitation in FIG. 20. Accordingly, the substantially continuous deposit portions 81*a* of the coupling agent 32 deposited on the exposed surfaces 20 of the filament bundles 11 of the first array 14 contact the exposed substantially continuous thin lengthwise strip portions 29 of the first surface 27 of the second film 26 that show between adjacent spaced apart filament bundles 21 of the second array 24. Substantially simultaneously therewith, the exposed surfaces 30 of the filament bundles 21 of the second array 24 contact with the substantially continuous deposit portions 81*b* of the coupling agent 32 deposited on the exposed substantially continuous thin lengthwise strip portions 19 of the first surface 17 of the first film 16 between the adjacent fiber bundles 11 of the first array 14, and further substantially simultaneously therewith, the coupling agent 32 of the interconnect deposit portions 81*c* of the substantially continuous deposits 81 substantially simultaneously interconnect the substantially continuous deposit portions 81*a* and 81*b* of the coupling agent 32.

Figure 22:
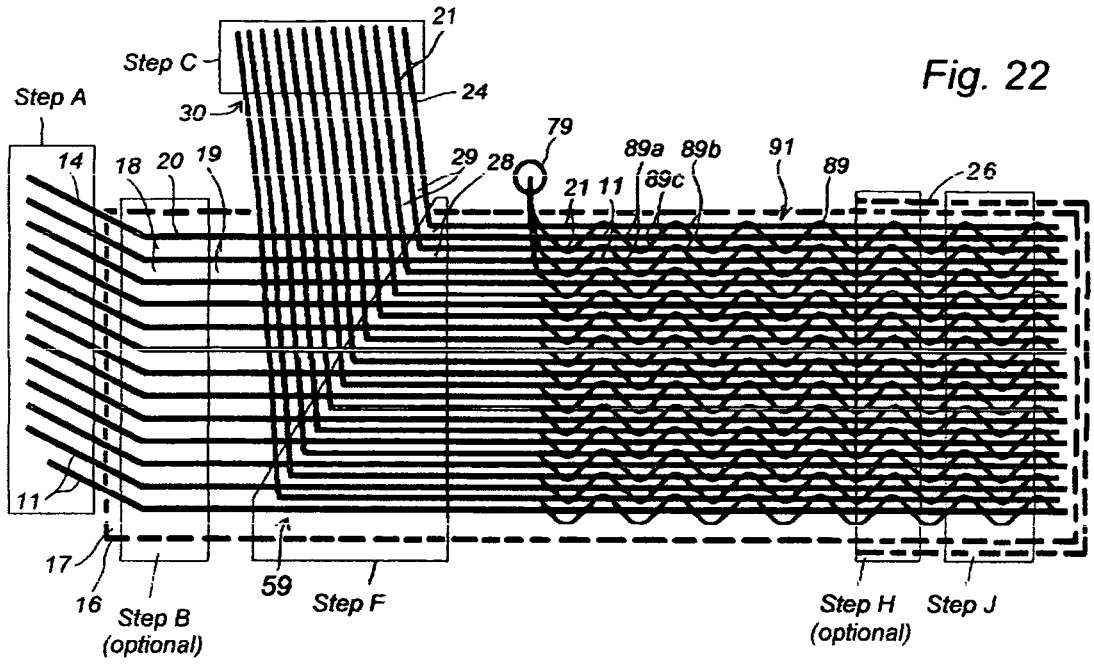
FIG. 22 illustrates another exemplary novel method for making the novel ballistic-resistant laminate structure resulting in an alternative embodiment of the novel ballistic-resistant laminate structure.

FIG. 22 illustrates an alternative embodiment of step E of the method for making the ballistic-resistant laminate structure 10 wherein substantially continuous deposits or "beads" 89 of the coupling agent 32 are provided in substantially continuous individual deposit patterns 91 generally of the type disclosed herein in FIG. 17. However, here the substantially continuous individual deposit patterns 91 of substantially continuous deposits 89 are used for making the ballistic-resistant laminate structure 10 as disclosed by example and without limitation in FIG. 14. Here, the individual deposit patterns 91 of substantially continuous deposits 89 are applied to the single layer of parallelized filament bundles 11, 21 of the closely packed array 59. Accordingly, the substantially continuous deposits 89 of the coupling agent 32 include both deposit portions 89*a* on the substantially continuous exposed surfaces 20 of the filament bundles 11 of the first array 14, and deposit portions 89*b* on the substantially continuous exposed surfaces 30 of the filament bundles 21 of the second array 24. Additionally, the substantially continuous deposits 89 of the coupling agent 32 includes substantially continuous deposit portions 89*c* of the coupling agent 32 that interconnect the deposit portions 89*a* on the exposed surfaces 20 of the filament bundles 11 of the first array 14, and the deposit portions 89*b* on the exposed surfaces 30 of the filament bundles 21 of the second array 24. Accordingly, the substantially continuous deposits 89 include: the first filament bundle deposit portions 89*a*, the second filament bundle deposit portions 89*b*, and the interconnect deposit portions 89*c* therebetween in a substantially continuous deposit or "bead" of the coupling agent 32 along the individual filament bundles 11 of the first array 14 and adjacent ones of the individual filament bundles 21 of the second array 24. Alternatively, substantially continuous deposit or "bead" 89 of the coupling agent 32 is applied along the individual filament bundles 21 of the second array 24 and adjacent ones of the individual filament bundles 11 of the first array 14.

Here, the deposit patterns 91 of the deposits 89 of the coupling agent 32 are substantially continuous serpentine "omega" patterns that are deposited using the bead-type applicator apparatus 79 disclosed herein or an alternative applicator apparatus 79 such as is now or may become available at a later time.

Alternatively, the deposit patterns 91 of the deposits 89 of the coupling agent 32 are applied after the interlaying step F of the method is performed, whereby the spaced apart filament bundles 11 of the first array 14 are first interlaid with the spaced apart filament bundles 21 of the second array 24. In the interlaying step F, the adjacent spaced apart filament bundles 11 of the first array 14 are laid into the substantially continuous spacings or gaps 28 between the adjacent spaced apart filament bundles 21 of the second array 24, and the adjacent spaced apart filament bundles 21 of the second array 14 are substantially simultaneously laid into substantially continuous spacings or gaps 18 between the adjacent spaced apart filament bundles 11 of the first array 14. Accordingly, the filament bundles 11, 21 of the first and second arrays 14, 24 are interlaid into a single layer of parallelized filament bundles 11, 21 as a closely packed array generally of the type indicated generally at reference numeral 59. Thereafter, the deposit patterns 91 of the deposits 89 of the coupling agent 32 are applied as disclosed herein.

After the deposit patterns 91 of the deposits 89 of the coupling agent 32 are applied, the second or "right" thin film 26 is applied. Thereafter, the anchoring, bonding or otherwise adhering of step J of the method results in the laminate structure 10 as disclosed herein.

Furthermore, the alternative embodiment of step E of the method illustrated by example and without limitation in FIG. 22 is optionally used to result in a variety of alternative configurations of the different ballistic-resistant laminate structure 10, including the different configurations disclosed, by example and without limitation, in FIG. 15 herein. Additionally, when this alternative step E is performed on both opposing first and second surfaces of the closely packed array generally of the type indicated generally at reference numeral 59, e.g., according to the description of FIG. 14, both the first and second films 16 and 26 are optionally adhered to the respective first and second surfaces 65 and 69. Accordingly, operating this alternative step E produces the resultant ballistic-resistant laminate structure 10 of FIG. 16 having the first and second films 16, 26 on the opposite surfaces 65, 69 of the closely packed array 59.

Figure 23:
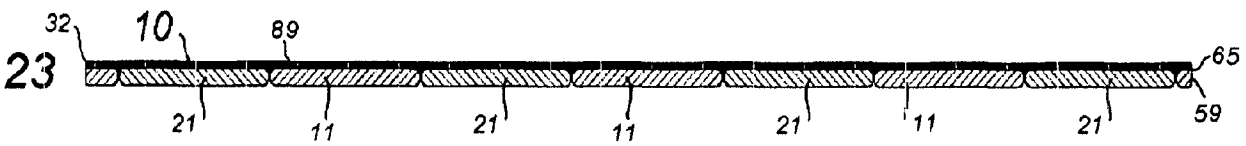
FIG. 23 is a close-up cross-section view of an exemplary novel ballistic-resistant laminate structure produced by novel step of the method for depositing substantially continuous deposits of a coupling agent as illustrated by example and without limitation in FIG. 22.

FIG. 23 illustrates the resultant ballistic-resistant laminate structure 10 produced by operating the alternative step E of FIG. 22, wherein the coupling agent 32 is limited to an agent that is curable prior to being wound onto the take-up beam 39. According to one embodiment of the invention, the curable coupling agent 32 is a thermoplastic elastomer or thermoplastic resin adhesive that is compatible with the high strength filaments 11, 21. According to one embodiment of the invention, the pressure rolls 36 are instead "chill" rolls. Such "chill" rolls 36 are generally well-known as disclosed, for example, by Mahn in U.S. Pat. No. 4,390,387, "Flocked Material Having First Thermosetting Adhesive Layer And Second Thermoplastic Adhesive Layer" issued Jun. 28, 1983, which is incorporated herein by reference. Accordingly, step J of the method is accomplished by passing through the oven 35. The resultant ballistic-resistant laminate structure 10 with the curable coupling agent 32 being now fully cured is passed around at least a portion of the chill roll 36, such that the curable coupling agent 32 is fully cured before being wound onto take-up beam 39.

The curing of the curable coupling agent 32 prior to winding the ballistic-resistant laminate structure 10 onto the take-up beam 39 obviates the need for either of the first or second films 16, 26, which are present primarily for separating adjacent layers of the ballistic-resistant laminate structure 10 on the take-up beam 39. Rather, the ballistic-resistant laminate structure 10 can be safely wound onto the take-up beam 39 without the already cured coupling agent 32 adhering, bonding or otherwise coupling to an adjacent layer of the ballistic-resistant laminate structure 10 on the take-up beam 39. Therefore, except as may be desirable for some end-user applications, one or both of the first or second films 16, 26 are optionally omitted.

Figure 24:
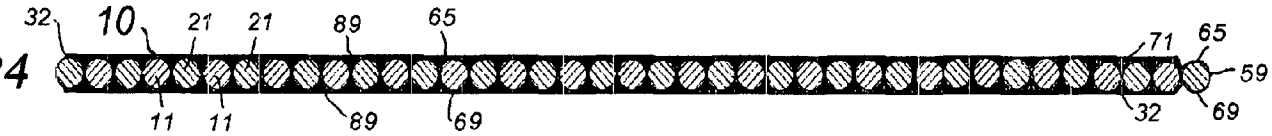
FIG. 24 is a close-up cross-section view of another exemplary novel ballistic-resistant laminate structure produced by novel step of the method for depositing substantially continuous deposits of a coupling agent as illustrated by example and without limitation in FIG. 22.

FIG. 24 illustrates another resultant ballistic-resistant laminate structure 10 produced by operating the alternative step E of FIG. 22, wherein the coupling agent 32 is limited to an agent that is curable prior to being wound onto the take-up beam 39. Furthermore, as illustrated here, the substantially continuous deposits 71 of coupling agent 32 are deposited onto the exposed second surfaces 69 of the filament bundles 11, 21, as disclosed herein by example and without limitation in FIG. 14. When the curable coupling agent 32 is the curable thermoplastic or thermoplastic resin coupling agent, the curable coupling agent 32 is cured prior to winding the ballistic-resistant laminate structure 10 onto the take-up beam 39, which obviates the need for either of the first or second films 16, 26. Rather, the ballistic-resistant laminate structure 10 can be safely wound onto the take-up beam 39 without the already cured coupling agent 32 adhering, bonding or otherwise coupling to an adjacent layer of the ballistic-resistant laminate structure 10 on the take-up beam 39. Therefore, except as may be desirable for some end-user applications, one or both of the first or second films 16, 26 are optionally omitted.

Figure 25:
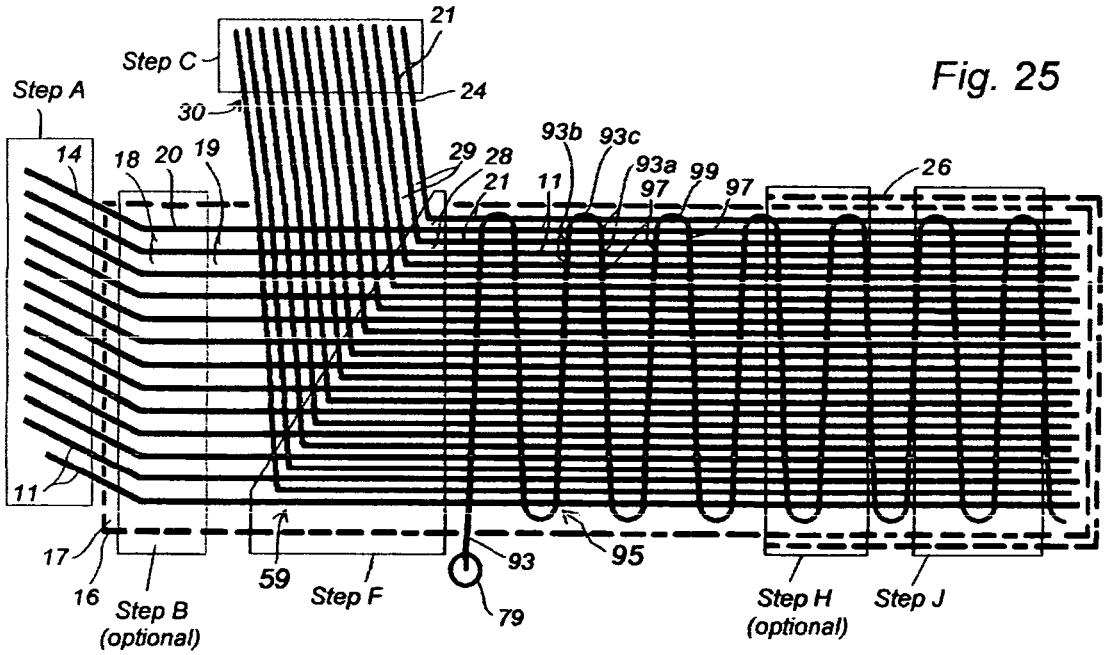
FIG. 25 illustrates yet another exemplary novel method for making the novel ballistic-resistant laminate structure resulting in an alternative embodiment of the novel ballistic-resistant laminate structure.

FIG. 25 illustrates another alternative embodiment of step E of the method for making the ballistic-resistant laminate structure 10 wherein a substantially continuous deposit or "bead" 93 of the coupling agent 32 is provided in a substantially continuous random deposit pattern 95 generally of the type disclosed herein in FIG. 20. However, here the substantially continuous individual deposit pattern 95 of the substantially continuous deposits 93 are used for making the ballistic-resistant laminate structure 10 as disclosed by example and without limitation in FIG. 14. Here, the substantially continuous random deposit pattern 95 of substantially continuous deposits 93 are applied to the single layer of parallelized filament bundles 11, 21 of the closely packed array 59.

Accordingly, the substantially continuous deposits 93 of the coupling agent 32 include both deposit portions 93*a* on the substantially continuous exposed surfaces 20 of the filament bundles 11 of the first array 14, and deposit portions 93*b* on the substantially continuous exposed surfaces 30 of the filament bundles 21 of the second array 24. Additionally, the substantially continuous deposits 89 of the coupling agent 32 includes substantially continuous deposit portions 93*c* of the coupling agent 32 that interconnect the deposit portions 93*a* on the exposed surfaces 20 of the filament bundles 11 of the first array 14, and the deposit portions 93*b* on the exposed surfaces 30 of the adjacent filament bundles 21 of the second array 24 when the first and second arrays 14, 24 are further parallelized and arrayed into the single closely packed array 59, as disclosed herein. Accordingly, the substantially continuous deposits 93 include: the first filament bundle deposit portions 93*a*, the second filament bundle deposit portions 93*b*, and the interconnect deposit portions 93*c* therebetween in a substantially continuous deposit or "bead" of the coupling agent 32 across the closely packed array 59 of alternately interlaid filament bundles 11, 21. Alternatively, substantially continuous deposit or "bead" 93 of the coupling agent 32 is applied along as individual unconnected lines 97 of the substantially continuous deposits 93. Else, the substantially continuous random deposit pattern 95 of the substantially continuous deposit 93 of coupling agent 32 is optionally formed as a substantially continuous pattern throughout at least a substantial portion of the length of the laminate structure 10. Accordingly, when the substantially continuous random deposit pattern 95 of the substantially continuous deposit 93 of coupling agent 32 is optionally formed as a substantially continuous pattern throughout the length of the laminate structure 10, as illustrated here by example and without limitation, joining portions 99 are formed between adjacent individual and otherwise substantially unconnected lines 97 of the substantially continuous deposits 93.

The alternative embodiment of step E of the method disclosed in FIG. 25 for making the ballistic-resistant laminate structure 10 results in substantially the laminate structure 10 disclosed in FIGS. 23 and 24. The alternative embodiment of step E of the method disclosed in FIG. 25 produces substantially the laminate structure 10 disclosed in FIGS. 15 and 16 when one or both of the first and second films are attached.

Alternative Embodiment

FIG. 26 through FIG. 30 illustrate one alternative embodiment of the laminate structure 10 wherein filament bundles 11 and 21 of the first and second arrays 14 and 24 are stacked instead of lying side by side. Accordingly, rather than interlaying the spaced apart filament bundles 11 of the first array 14 with the spaced apart filament bundles 21 of the second array 24, the spaced apart filament bundles 11 of the first array 14 are overlaid with the spaced apart filament bundles 21 of the second array 24 and adhered thereto. The thin lengthwise strip portions 29 of the first surface 27 of the second film 26 that are exposed between adjacent spaced apart filament bundles 21 of the second array 24 are adhered to the opposing lengthwise strip portions 19 of the first surface 17 of the first film 16 that are exposed between adjacent spaced apart filament bundles 11 of the first array 14 between adjacent stacked filament bundles 11 and 21 of the first and second arrays 14 and 24.

Accordingly, here the alternative method substitutes a step K for the step F of interlaying the spaced apart filament bundles 11 of the first array 14 with the spaced apart filament bundles 21 of the second array 24. Step K of this alternative embodiment includes substantially aligning and laying the spaced apart filament bundles 11 of the first array 14 substantially directly over the spaced apart filament bundles 21 of the second array 24. Accordingly, the adjacent spaced apart filament bundles 11 of the first array 14 and the spaced apart filament bundles 21 of the second array 14 are substantially aligned and substantially simultaneously laid over one another or stacked, while the substantially continuous spacings or gaps 18 between the adjacent spaced apart filament bundles 11 of the first array 14 are substantially aligned and overlaid or matched with and spaced away from the substantially continuous spacings or gaps 28 between the adjacent spaced apart filament bundles 21 of the second array 24 by the thickness of the stacked filament bundles 11 and 21 of the first and second arrays 14 and 24.

Step K of this alternative embodiment is thus contacting the exposed surfaces 30 of the filament bundles 21 of the second array 24 with the exposed surfaces 20 of the filament bundles 11 of the first array 14 with the substantially continuous deposits 31 of coupling agent 32 therebetween.

The alternative method substitutes a step L for the step G of contacting the substantially continuous deposits 31 of the coupling agent 32 deposited on the exposed surfaces 20 of the filament bundles 11 of the first array 14 with the exposed substantially continuous thin lengthwise strip portions 29 of the first surface 27 of the second film 26 that show between adjacent spaced apart filament bundles 21 of the second array 24. Step L of this alternative embodiment includes, substantially simultaneously with the contacting the substantially continuous deposits 31 of the coupling agent 32 deposited on the exposed surfaces 20 of the filament bundles 11 of the first array 14 with the exposed surfaces 30 of the filament bundles 21 of the second array 24, contacting the exposed substantially continuous thin lengthwise strip portions 29 of the first surface 27 of the second film 26 with the substantially continuous deposits 33 of the coupling agent 32 deposited on the exposed substantially continuous thin lengthwise strip portions 19 of the first surface 17 of the first film 16 that show between the adjacent fiber bundles 11 of the first array 14.

Step L of the method is optionally operated substantially simultaneously with step K of overlaying the spaced apart filament bundles 11 of the first array 14 with the spaced apart filament bundles 21 of the second array 24.

Optionally, step L of the method further includes the first and second application rollers or mandrels 15 and 25 pressing together the first and second arrays 14 and 24 of fiber bundles 11 and 21 into pressurized contact with the substantially continuous deposits 31 of the coupling agent 32 compressed therebetween, while substantially simultaneously pressing together into pressurized contact the exposed strips of the first surfaces 17 and 27 of the respective first and second films 16 and 26 between the stacked fiber bundles 11 of the first array 14.

The lengthwise strip portions 19 of the first surface 17 of the first film 16 exposed between adjacent filament bundles 11 of the first array 14 are thus pressed into pressurized contact with the opposite substantially continuous thin lengthwise strip portions 29 of the first surface 27 of the second film 26 exposed between adjacent filament bundles 21 of the second array 24, with the substantially continuous deposits 33 of the coupling agent 32 deposited on the exposed substantially continuous thin lengthwise strip portions 19 of the first surface 17 of the first film 16 compressed therebetween, which portion of step L of this alternative method is optionally operated substantially simultaneously with the overlaying of step K.

This alternative method also alternatively omits the step D of the method in which the second film 26 is applied to the second array 24 of filament bundles 21, and instead includes step H in which the second film 26 is applied to the second array 24 of filament bundles 21 at a later stage after accomplishment of alternative step K of overlaying the spaced apart filament bundles 11 of the first array 14 with the spaced apart filament bundles 21 of the second array 24, and after accomplishment of the portion of alternative step L of contacting the surfaces 30 of the filament bundles 21 of the second array 24 with the exposed surfaces 30 of the filament bundles 21 of the second array 24 with the substantially continuous deposits 31 of coupling agent 32 therebetween, and substantially simultaneously therewith contacting the substantially continuous thin lengthwise strip portions 19 of the first surface 17 of the first film 16 that show between the adjacent fiber bundles 11 of the first array 14 with the opposite substantially continuous thin lengthwise strip portions 29 of the first surface 27 of the second film 26 exposed between adjacent filament bundles 21 of the second array 24 with the substantially continuous deposits 33 of the coupling agent 32 therebetween, which portion of step L of the method is optionally operated substantially simultaneously with the overlaying of step K.

When step D of the method is omitted, and the method includes substitution of the optional step H, the substituted step H is operated following alternative step L. Optional step H, when present, includes passing the overlayered first and second filament bundles 11 and 21 of the first and second arrays 14 and 24 over the second or "right" film application roller or mandrel 25 where a second or "right" film 26 of thin and flexible polyethylene or other suitable material is applied to the second array 24 of filament bundles 21.

Here, optional step H when present, includes contacting the substantially continuous deposits 31 of the coupling agent 32 deposited on the exposed surfaces 20 of the filament bundles 11 of the first array 14 with the exposed surfaces 30 of the filament bundles 21 of the second array 24, and includes substantially simultaneously contacting the substantially continuous deposits 33 of the coupling agent 32 deposited on the exposed substantially continuous thin lengthwise strip portions 19 of the first surface 17 of the first film 16 with the substantially continuous thin lengthwise strip portions 29 of the first surface 27 of the second film 26.

The method includes a step M of anchoring, bonding or otherwise adhering at least a portion of the exposed surfaces 20 of the filament bundles 11 of the first array 14 to corresponding portions of the exposed surfaces 30 of the filament bundles 21 of the second array 24.

Step M of the method includes, substantially simultaneously with the anchoring, bonding or otherwise adhering at least a portion of the exposed surfaces 20 of the filament bundles 11 of the first array 14 to corresponding portions of the exposed surfaces 30 of the filament bundles 21 of the second array 24, substantially simultaneously anchoring, bonding or otherwise adhering at least a portion of the exposed substantially continuous thin lengthwise strip portions 19 of the first surface 17 of the first film 16 that show between the adjacent fiber bundles 11 of the first array 14 to corresponding portions of the exposed substantially continuous thin lengthwise strip portions 29 of the first surface 27 of the second film 26 that show between adjacent spaced apart filament bundles 21 of the second array 24. Accordingly, substantially continuous thin lengthwise strip adhesions 103 are formed lengthwise strip portions 19 of the first surface 17 of the first film 16 and lengthwise strip portions 29 of the first surface 27 of the second film 26.

According to one embodiment, the coupling agent 32 is a conventional pressure sensitive adhesive, or PSA, of a type which forms a bond when pressure is applied to marry the adhesive with the adhered. No solvent, water, or heat is needed to activate the adhesive. It is commonly used in pressure sensitive tapes, labels, note pads, automobile trim, and a wide variety of other products. As the name "pressure sensitive" indicates, the degree of bond is influenced by the amount of pressure which is used to apply the adhesive to the surface. Surface factors such as smoothness, surface energy, removal of contaminants, etc. are also important to proper bonding. PSAs are usually designed to form a bond and hold properly at room temperatures. PSAs typically reduce or lose their tack at cold temperatures and reduce their shear holding ability at high temperatures: Specialty adhesives are made to function at high or low temperatures. Accordingly, the anchoring, bonding or otherwise adhering of step M of this alternative method is automatically accomplished when the assembled ballistic-resistant laminate structure 10 is wound onto the take-up beam 39, as illustrated in FIG. 1 and discussed herein above.

Optionally, the anchoring, bonding or otherwise adhering of step M of this alternative method includes applying heat, applying pressure, or applying a combination thereof. For example, applying heat, applying pressure, or applying a combination thereof is particularly effective in operating the anchoring, bonding or otherwise adhering of step M of the method when the first and second films 16, 26 are thermoplastic or other polymeric films, and the coupling agent 32 is a compatible polymeric material. By example and without limitation, step M of the method includes passing the combination of the first and second arrays 14, 24 of fiber bundles 11, 21 and the first and second films 16, 26 into an oven 35 to provide the anchoring, bonding or otherwise adhering of step M between the first and second fiber bundles 11, 21 and the deposit 31 of coupling agent 32, as well as between the first and second films 16, 26 and the deposits 33 of coupling agent 32.

Alternatively, the coupling agent 32 is a polymeric latex deposited onto the exposed surfaces 20 of the filament bundles 11 of the first array 14 and onto the exposed substantially continuous thin lengthwise strip portions 19 of the first surface 17 of the corresponding first film 16, and subsequently bonded thereto with heat and/or pressure. The overlaid fiber bundles 11, 21 between the first and second films 16, 26 are passed into the nip between pressure rolls 36. The overlaid fiber bundles 11, 21, with the films 16, 26 may then be heated, if desired.

In another alternative, the anchoring, bonding or otherwise adhering of step M of the method includes passing the overlaid fiber bundles 11, 21, with the associated films 16, 26 between a pre-lamination roller 37 and a heated platen 38. The heated platen 38 supports the fiber bundles 11, 21 and the films 16, 26 against pressure exerted by the pre-lamination roller 36. After heating, the fiber bundles 11, 21 and the associated films 16, 26 are laminated by passing them through a pair of heated nip rolls 20, 21 to supply proper laminating forces.

The anchoring, bonding or otherwise adhering of step M of the method may also include applying heat, applying pressure, or applying a combination thereof when the coupling agent 32 is an adhesive of a type which curing thereof is promoted by heat, pressure, or a combination thereof.

The assembled ballistic-resistant laminate structure 10 is then wound onto a take-up beam 39. Alternatively, curing of the coupling agent 32 takes place after the overlaid fiber bundles 11, 21 and the attached films 16, 26 are wound onto the take-up beam 39. For example, when the coupling agent 32 is a PSA, an aerobic or air-curing adhesive.

Figure 26:
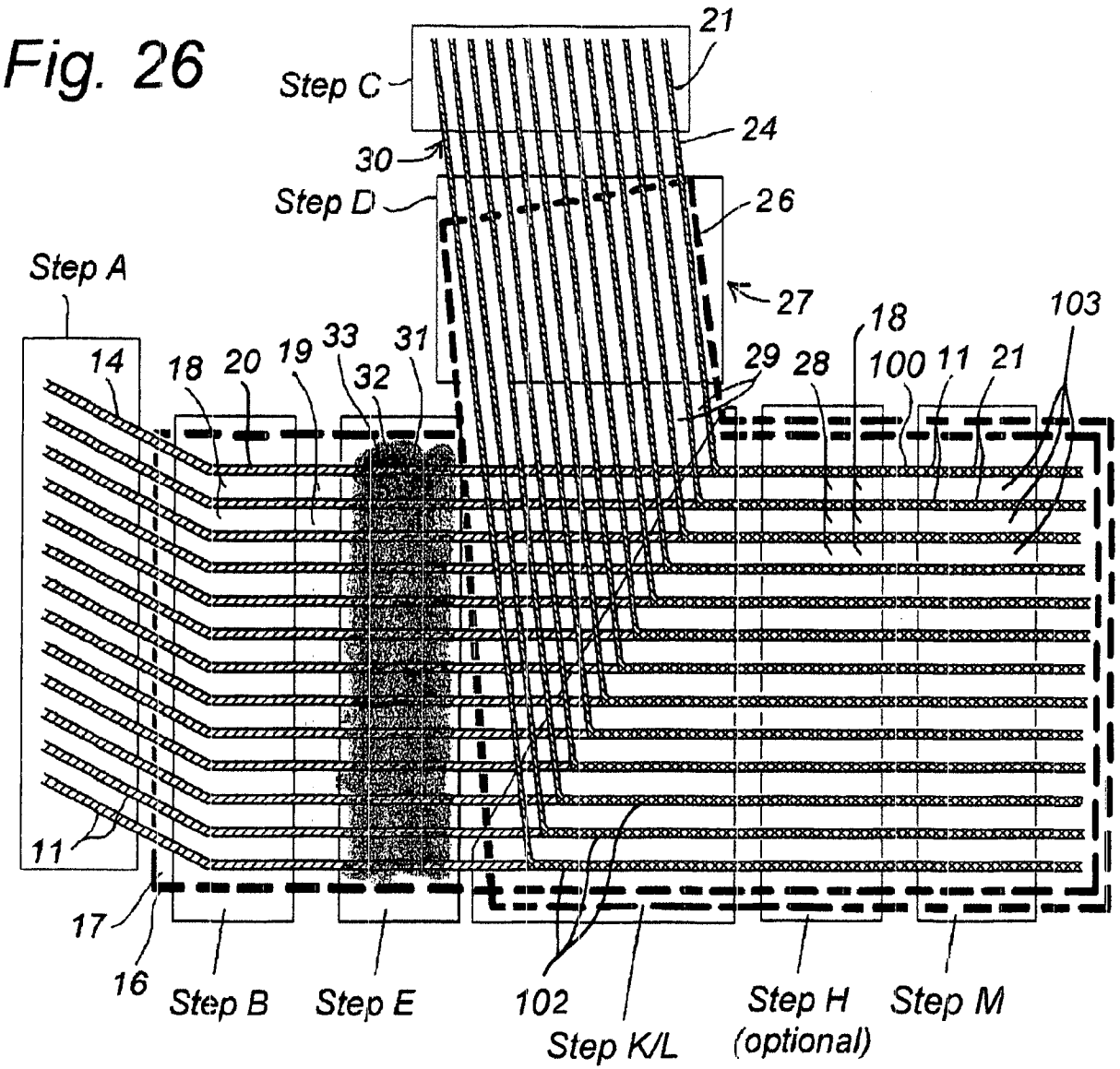

FIG. 26 is a plan view of the ballistic-resistant laminate structure 10 that illustrates by example and without limitation the above alternative method for making the same. This view more clearly illustrates the substantially uniform and continuous spacings 18 between adjacent filament bundles 11 that expose the substantially continuous thin lengthwise portions 19 of the first surface 17 of the first film 16 that show between adjacent spaced apart filament bundles 11. This view of the ballistic-resistant laminate structure 10 also illustrates the substantially continuous deposits 31 of the coupling agent 32 deposited onto the exposed surfaces 20 of the filament bundles 11 of the first array 14 that face away from the first film 16. Here, the spaced apart filament bundles 11 of the first array 14 are illustrated overlaid with the spaced apart filament bundles 21 of the second array 24, with the substantially uniform and continuous spacings 18 and 28 between adjacent stacked filament bundles 11 and 21 parallelized and arrayed into a single spaced array 100 formed of double layer filaments 102 having a predetermined uniform number of filament bundles 11 and 21 per inch of width.

Figure 27:
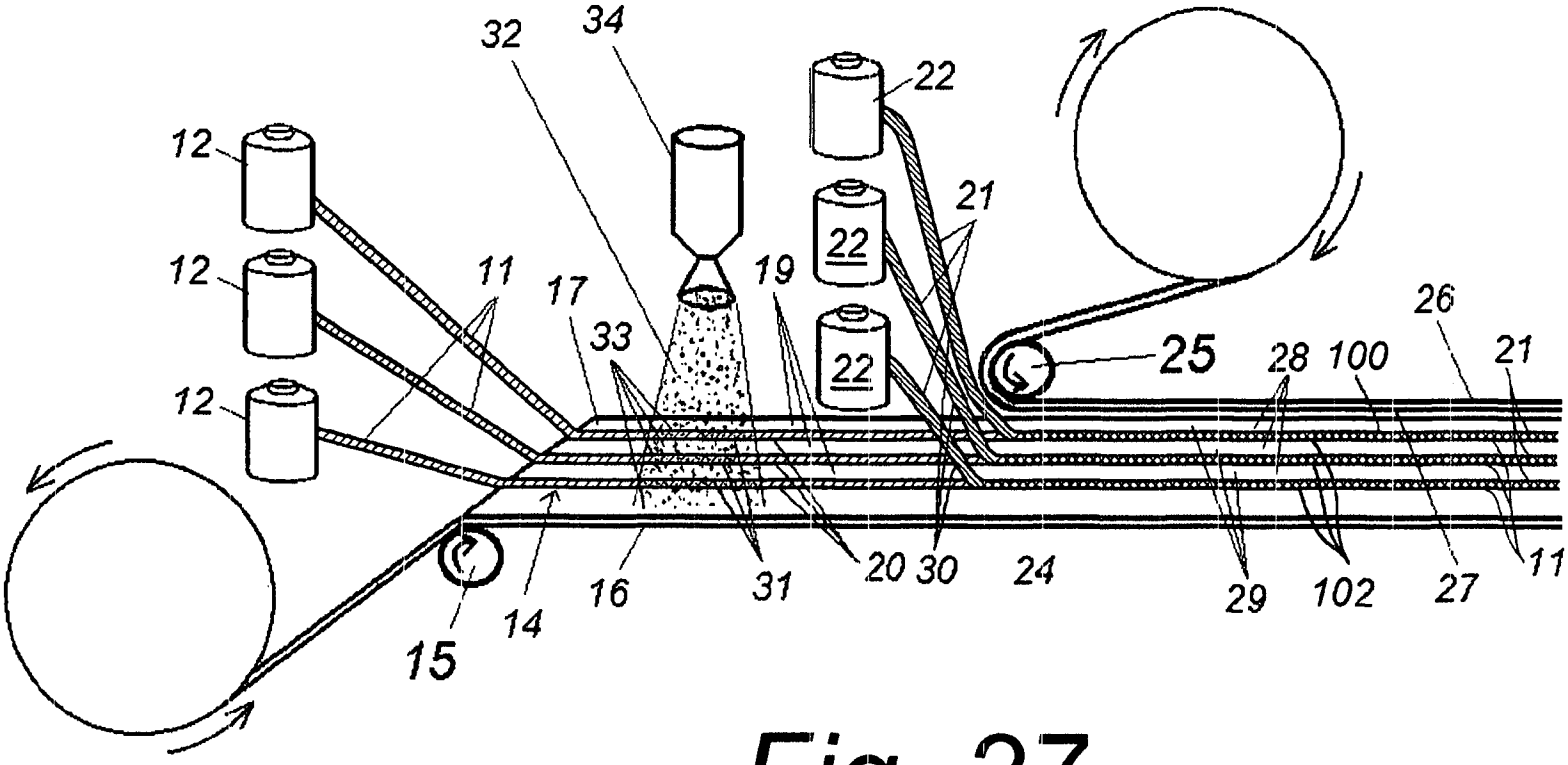

FIG. 27 is a pictorial view of the ballistic-resistant laminate structure 10 that illustrates by example and without limitation the alternative method for making the same. This view also more clearly illustrates the substantially uniform and continuous spacings 18 between adjacent filament bundles 11 that expose the substantially continuous thin lengthwise portions 19 of the first surface 17 of the first film 16 that show between adjacent spaced apart filament bundles 11. This view of the ballistic-resistant laminate structure 10 also illustrates the substantially continuous deposits 31 of the coupling agent 32 deposited onto the exposed surfaces 20 of the filament bundles 11 of the first array 14 that face away from the first film 16. This Figure also illustrates the substantially continuous deposits 33 of the coupling agent 32 deposited onto the exposed substantially continuous thin lengthwise portions 19 of the first surface 17 of the first film 16 that show in the substantially uniform and continuous spacings 18 between adjacent spaced apart filament bundles 11.

Also illustrated are the overlaying of the spaced apart filament bundles 11 of the first array 14 with the spaced apart filament bundles 21 of the second array 24.

Figure 28:
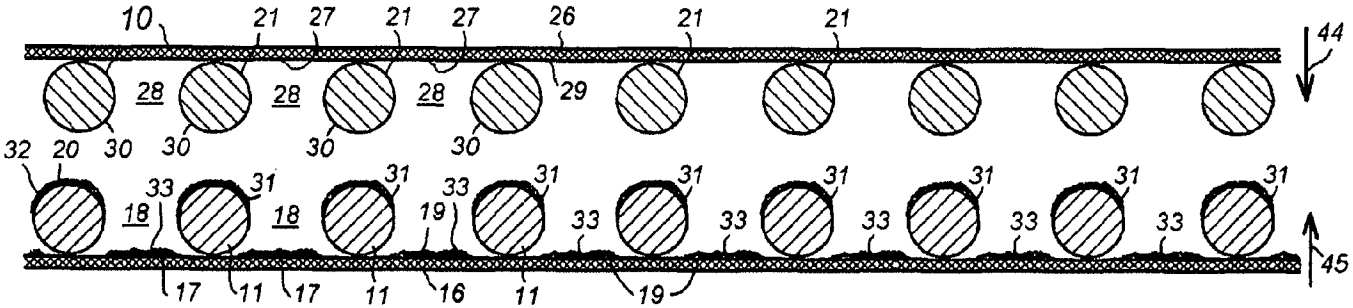

FIG. 28 is a close-up cross-section view that illustrates a stage in the alternative method for making the ballistic-resistant laminate structure 10. Here, the step A of forming the first or "left" plurality of bundles 11 of twisted or untwisted high strength filaments or fibers is already accomplished. The step B of passing the first single layer array 14 of filament bundles 11 over the first or "left" film application roller or mandrel 15 and applying the thin and flexible first or "left" film 16 is also accomplished. FIG. 28 illustrates the first surface 17 of the first film 16 being arranged in close proximity to the filament bundles 11 of the first array 14, and further illustrates the arrangement of the filament bundles 11 on the first surface 17 of the first film 16 for forming the substantially uniform and continuous spacings 18 between adjacent filament bundles 11, whereby the substantially continuous thin lengthwise portions 19 of the first surface 17 of the first film 16 are exposed as thin strips of the first surface 17 that show between adjacent spaced apart filament bundles 11.

Here, also, the depositing step E of the method is accomplished, whereby the substantially continuous deposits 31 of an coupling agent 32 are deposited onto the exposed surfaces 20 of the filament bundles 11 of the first array 14 that face away from the first film 16. Furthermore, the substantially continuous deposits 33 of the coupling agent 32 are deposited onto the exposed substantially continuous thin lengthwise strip portions 19 of the first surface 17 of the corresponding first film 16 that show between the adjacent fiber bundles 11 of the first array 14.

As illustrated here, the depositing step E of the alternative method disassociates the substantially continuous deposits 31 of the coupling agent 32 deposited on the exposed surfaces 20 of the filament bundles 11 of the first array 14 from the substantially continuous thin lengthwise strip portions 19 of the first surface 17 of the corresponding first film 16 exposed between the spaced apart fiber bundles 11 of the first array 14. The depositing step E of the alternative method further disassociates the substantially continuous deposits 33 of the coupling agent 32 deposited on the exposed substantially continuous thin lengthwise strip portions 19 of the first surface 17 of the corresponding first film 16 from the adjacent fiber bundles 11 of the first array 14. Additionally, it has been empirically determined that, when the coupling agent 32 is deposited by spraying, the interconnecting leakage portions 40 of coupling agent 32 that is leaked or otherwise deposited by overspray, as discussed herein, are minimized. Accordingly, intermittent interconnecting leakage portions 40 of coupling agent 32 are indeed minimal between the substantially continuous deposits 31 of the coupling agent 32 deposited on the exposed surfaces 20 of the filament bundles 11 and the adjacent substantially continuous deposits 33 on the exposed substantially continuous thin lengthwise strip portions 19 of the first surface 17 of the corresponding first film 16.

Furthermore, as also illustrated herein, the depositing step E of the method may intentionally or inadvertently include intermittent interconnecting portions 42 of the coupling agent 32 directly between the filament bundles 11 of the first array 14 and portions of the adjacent exposed substantially continuous thin lengthwise strip portions 19 of the first surface 17 of the corresponding first film 16. Additionally, it has been empirically determined that, when the coupling agent 32 is deposited by spraying, the interconnecting leakage portions 42 of coupling agent 32 that is leaked or otherwise deposited by overspray, as discussed herein, are minimized.

Additionally, since both the intermittent interconnecting portions 40 and 42 of the coupling agent 32 are minimal, interconnecting leakage portions 42*a*, 42*b*, and 42*c* of the coupling agent 32, as discussed herein, are minimal to nonexistent.

As also illustrated here, the step C of forming a second or "right" plurality of bundles 21 of twisted or untwisted high strength filaments or fibers is also already accomplished here.

The step D of passing the second single layer array 24 of filament bundles 21 over the second or "right" film application roller or mandrel 25 and applying a thin and flexible second or "right" film 26 is also accomplished.

The spaced apart filament bundles 21 of the second array 24 are illustrated as being arranged in close proximity to the spaced apart filament bundles 11 of the first array 14. The first surface 17 of the first film 16 is illustrated for forming the substantially uniform and continuous spacings 18 between adjacent filament bundles 11, whereby the substantially continuous thin lengthwise portions 19 of the first surface 17 of the first film 16 are exposed as thin strips of the first surface 17 that show between adjacent spaced apart filament bundles 11. The first surface 27 of the second film 26 is illustrated for forming the substantially uniform and continuous spacings 28 between adjacent filament bundles 21, whereby the substantially continuous thin lengthwise portions 29 of the first surface 27 of the second film 26 are exposed as thin strips of the first surface 27 that show between adjacent spaced apart filament bundles 21.

As also illustrated here, the spaced apart filament bundles 11 of the first array 14 are substantially aligned with the spaced apart filament bundles 21 of the second array 24.

The alternative step K of overlaying the spaced apart filament bundles 11 of the first array 14 with the spaced apart filament bundles 21 of the second array 24 is indicated by the arrows 44 and 45. Accordingly, the anchoring, bonding or otherwise adhering step M of the alternative method includes anchoring, bonding or otherwise adhering at least a portion of the exposed surfaces 20 of the filament bundles 11 of the first array 14 to corresponding portions of the exposed surfaces 30 of the filament bundles 21 of the second array 24. Substantially simultaneously, the anchoring, bonding or otherwise adhering step M of the alternative method includes anchoring, bonding or otherwise adhering at least a portion of the exposed substantially continuous thin lengthwise strip portions 19 of the first surface 17 of the first film 16 that show between adjacent spaced apart filament bundles 11 of the first array 24 to corresponding portions of the exposed substantially continuous thin lengthwise strip portions 29 of the first surface 27 of the second film 26 that show between adjacent spaced apart filament bundles 21 of the second array 24.

Figure 29:
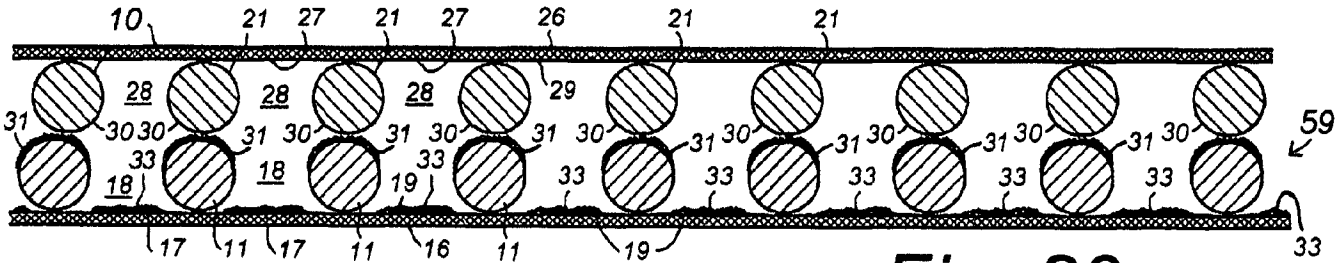

FIG. 29 is a cross-section view that illustrates the spaced apart filament bundles 11 of the first array 14 substantially aligned and overlaid with the spaced apart filament bundles 21 of the second array 24. As illustrated here, the portion of alternative step L of contacting the substantially continuous deposits 31 of the coupling agent 32 deposited on the exposed surfaces 20 of the filament bundles 11 of the first array 14 with the substantially aligned exposed surfaces 30 of the filament bundles 21 of the second array 24 is already accomplished.

Figure 30:
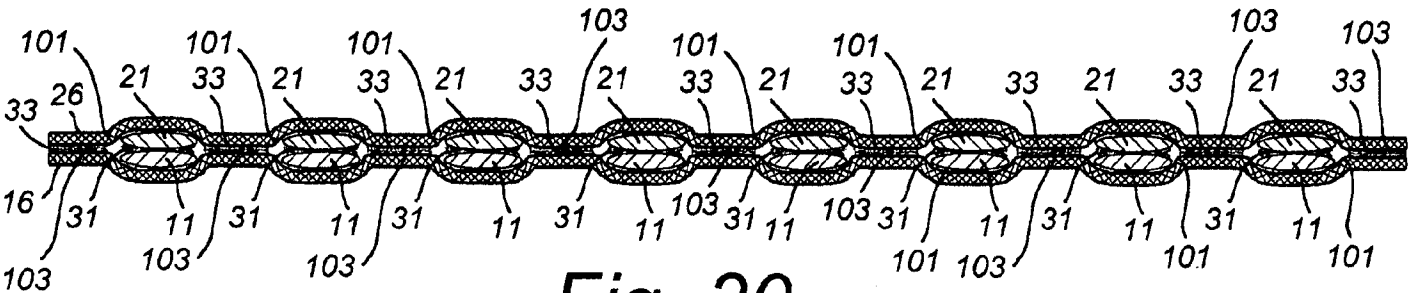

FIG. 30 illustrates the filament bundles 11 and 21 of the first and second arrays 14 and 24 being compressed between the first and second films 16, 26. Accordingly, the filament bundles 11, 21 are formed into flatter and more square or oblong shapes from the generally round or cylindrical shapes illustrated in earlier Figures. Such forming of the filament bundles 11, 21 into flatter and squarer shapes is accomplished, for example, in the optional stage of step L of the method wherein the first and second application rollers or mandrels 15 and 25 are operated in a known manner for applying pressure for compressing therebetween the first and second arrays 14 and 24 of fiber bundles 11 and 21 onto the first and second films 16 and 26, as indicated by arrows 48. Accordingly, the overlaid fiber bundles 11 and 21 are flattened and spread across the first surfaces 17 and 27 of the respective first and second films 16 and 26.

Additionally accomplished is the portion of step L of contacting the substantially continuous thin lengthwise strip portions 29 of the first surface 27 of the second film 26 that show between adjacent spaced apart filament bundles 21 of the second array 24 with the substantially continuous deposits 33 of the coupling agent 32 deposited on the exposed substantially continuous thin lengthwise strip portions 19 of the first surface 17 of the first film 16 that show between the adjacent fiber bundles 11 of the first array 14.

Thereafter, the step M of the alternative method includes anchoring, bonding or otherwise adhering either continuous or at least intermittent portions of surfaces 20 of the filament bundles 11 of the first array 14 at least intermittently to the continuous or at least intermittent portions of surfaces 30 of the filament bundles 21 of the second array 24 with the substantially continuous deposits 31 of coupling agent 32 deposited therebetween. In alternative step J anchoring, bonding or otherwise adhering of at least portions of the exposed substantially continuous thin lengthwise strip portions 29 of the first surface 27 of the second film 26 that show between adjacent spaced apart filament bundles 21 of the second array 24 to corresponding portions of the exposed substantially continuous thin lengthwise strip portions 19 of the first surface 17 of the corresponding first film 16 that show between the adjacent fiber bundles 11 of the first array 14 with the substantially continuous deposits 33 of coupling agent 32 deposited therebetween.

Since both the intermittent interconnecting portions 40 and 42 of the coupling agent 32 are minimal to nonexistent, as discussed herein, the double layer filaments 102 of mutually adhered stacked filament bundles 11 and 21 of the first and second arrays 14 and 24 are substantially free floating but substantially fully contained within substantially continuous tubular pockets or sleeves 101 formed between the opposing first surfaces 17 and 27 of the first and second films 16 and 26 by adhesions 103 between mutually adhered lengthwise strip portions 19 and 29. This substantially free floating yet contained nature of the double layer filaments 102 of mutually adhered stacked filament bundles 11 and 21 of first and second arrays 14 and 24 increases flexibility of the resulting assembled ballistic-resistant laminate structure 10.

Figure 31:
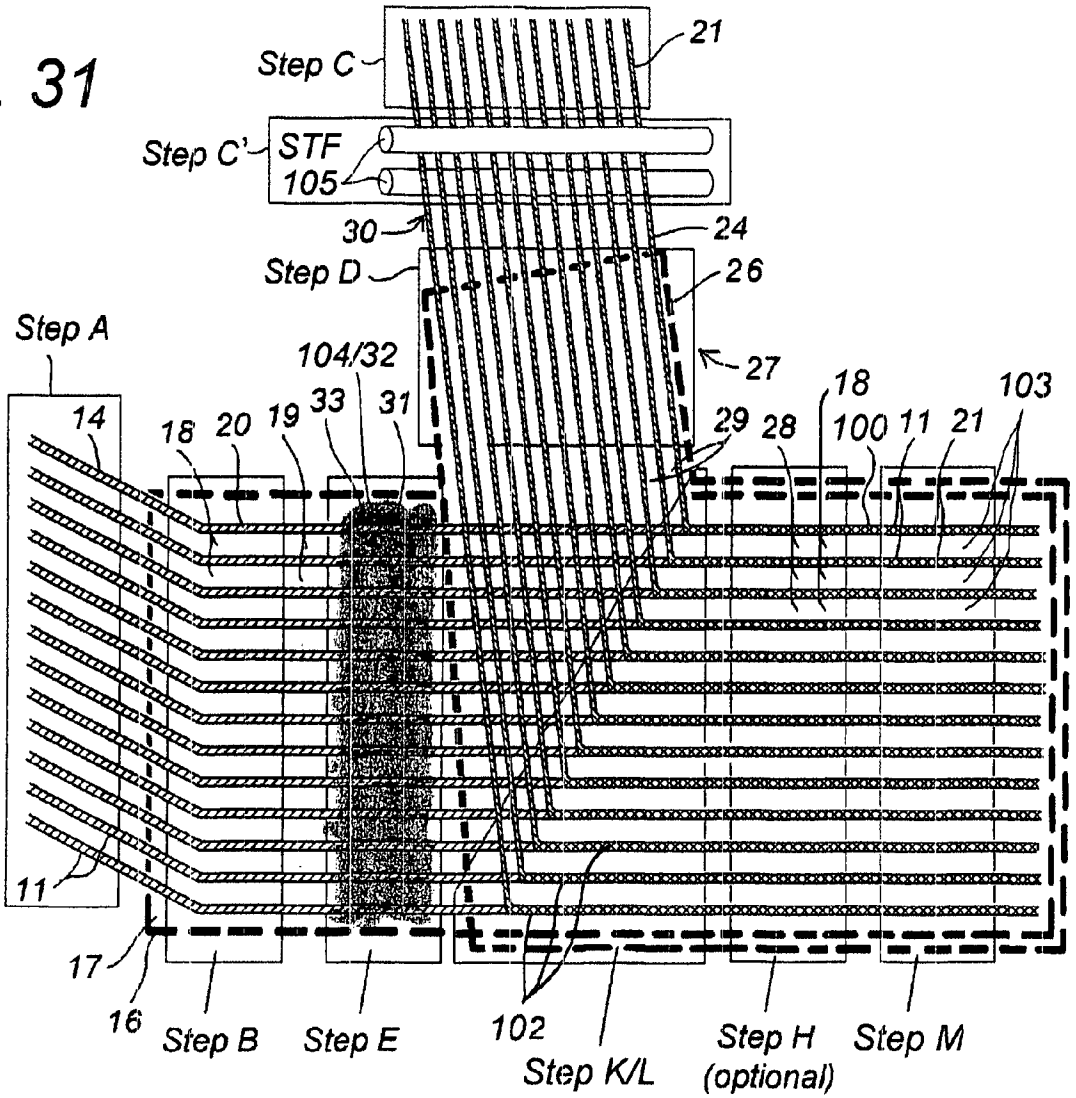
FIG. 31 illustrates an optional novel enhanced embodiment of the laminate structure further including a liquid-to-solid phase change material or PCM in combination with the high strength filaments or fibers.

FIG. 31 illustrates an optional enhanced embodiment of the laminate structure 10 illustrated herein, wherein a liquid-to-solid phase change material or PCM 104 is used in combination with the ballistic-resistant laminate structure 10 for body armor. The PCM 104 is composed of hard particles suspended in a flowable liquid medium such as polyethylene glycol, which is non-toxic, and can withstand a wide range of temperatures. The hard particles suspended in the flowable liquid medium of polyethylene glycol are nano-particles of a hard substance such as silica. This combination of flowable liquid medium and hard components results in a material with unusual properties.

During normal handling, this normally fluid phase change material or PCM 104 is very deformable and flows like a liquid so that body armor formed of the enhanced ballistic-resistant laminate structure 10 is light and flexible, which allows soldiers to be more mobile and does not interfere with an individual running or aiming a weapon. However, upon impact of the vest or other body armor by a bullet or high velocity frag, this PCM 104 undergoes a phase change whereby it rapidly transitions or coagulates from liquid phase to solid phase. The normally flexible enhanced ballistic-resistant laminate structure 10 thus transitions to a rigid material, which prevents the projectile from defeating the armor and penetrating the wearer's body.

The enhanced ballistic-resistant laminate structure 10 is made by soaking phase change material or PCM 104 into the filament bundles 11 and 21 of one or more of the layers of the fabric formed of the ballistic-resistant laminate structure 10. The resulting ballistic-resistant laminate structure 10 holds the PCM 104 in place, and also helps to stop the projectile. The PCM-saturated ballistic-resistant fabric structure 10 can be soaked, draped, and sewn just like any other fabric. The ballistic-resistant laminate structure 10 enhanced with the phase change material or PCM 104 is a new material that is low cost and lightweight yet offers equivalent or superior ballistic properties as compared to current ballistic-resistant fabrics, but has more flexibility with less thickness. Body armor made with the ballistic-resistant laminate structure 10 enhanced with the phase change material or PCM 104 is also much more stab resistant than conventional body armor for better protection from hand-to-hand attacks with sharp weapons.

Here, the phase change material or PCM 104 is used in combination with the alternative embodiment of the laminate structure 10 illustrated in FIG. 26 through FIG. 30. The PCM 104 may be compatible with the coupling agent 32. In other words, the PCM 104 may be used in the presence of the coupling agent 32, or the PCM 104 may be even mixed or otherwise combined with the coupling agent 32, without inhibiting effective adhesion of the coupling agent 32. For example, when the PCM 104 is compatible with the coupling agent 32, the PCM 104 is combined with the coupling agent 32 in an alternative enhancing step E' is substituted for step E of depositing the substantially continuous deposits 31 and 33 of coupling agent 32. Accordingly, substituted alternative enhancing step E' is operated for depositing substantially continuous deposits 131 of combined PCM 104 and coupling agent 32 on the exposed surfaces 20 of the filament bundles 11 of the first array 14 and simultaneously depositing substantially continuous deposits 133 of combined PCM 104 and coupling agent 32 onto the exposed substantially continuous thin lengthwise strip portions 19 of the first surface 17 of corresponding first film 16 that show between the adjacent fiber bundles 11 of the first array 14. Thereafter, at least the combined PCM 104 component is permitted to soak into and impregnate filament bundles 11.

Optionally, this optional enhanced embodiment further includes an enhancement step C' of initially soaking or impregnating the filament bundles 11 of the second array 24 in PCM 104 before the filament bundles 21 are overlaid or stacked with the filament bundles 11 into double layer filaments 102 in step K of the alternative embodiment. The enhancement step C' optionally further includes a process of squeezing excess quantities of the PCM 104 from the filament bundles 21. For example, when present enhancement step C' optionally includes the process of passing the filament bundles 21 through one or more sets of squeeze rollers 105 adapted for squeezing out excess quantities of PCM 104, whereby the filament bundles 21 are impregnated with PCM 104, but the PCM 104 is substantially contained by the filament bundles 21.

After impregnation with phase change material or PCM 104, filament bundles 11, 21 are processed as disclosed herein. Whether or not enhancement step C' includes optional squeeze rollers 105 and the squeezing process for removing excess quantities of the PCM 104, the PCM 104 is effectively contained in combination with the filament bundles 11, 21 in the array of substantially continuous tubular pockets or sleeves 101 formed between the opposing first surfaces 17 and 27 of respective first and second films 16 and 26 by adhesions 103 between mutually adhered lengthwise strip portions 19 and 29.

Figure 32:
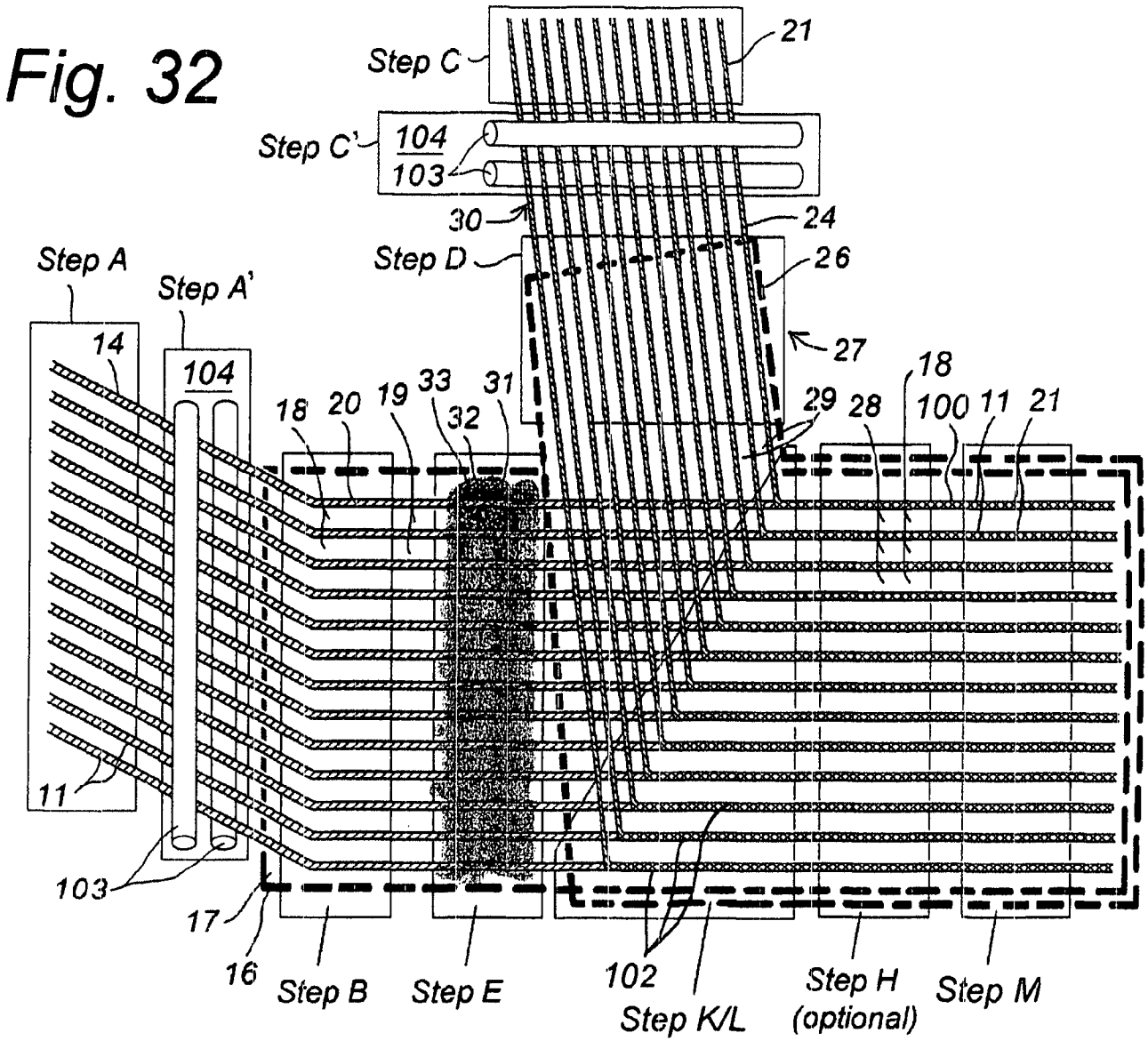
FIG. 32 illustrates a novel alternative enhanced embodiment, wherein the phase change material or PCM is used in combination with the alternative embodiment of the novel laminate structure.

FIG. 32 illustrates an alternative enhanced embodiment, wherein the phase change material or PCM 104 is used in combination with the alternative embodiment of the laminate structure 10 illustrated herein. For example, the optional enhanced embodiment includes one or both of an enhancement step A' and an enhancement step C' of initially soaking or impregnating the filament bundles 11 and 21 of the respective first and second arrays 14 and 24 in the PCM 104 before the filament bundles 11, 21 are overlaid or stacked into double layer filaments 102 in step K of the alternative embodiment. When present, enhancement steps A' and C' are optionally provided between respective step A and step C of forming a first and second or "left" and "right" pluralities of bundles 11 and 21 of untwisted high strength filaments or fibers. The enhancement steps A' and C' optionally further include the process of squeezing excess quantities of the PCM 104 from the respective pluralities of bundles 11 and 21. For example, when present enhancement steps A' and C' optionally include the process of passing the respective pluralities of bundles 11 and 21 through one or more sets of squeeze rollers 105 adapted for squeezing out excess quantities of PCM 104, whereby the filament bundles 11, 21 are impregnated with PCM 104 but the PCM 104 is substantially contained by the filament bundles 11, 21.

After impregnation with phase change material or PCM 104, filament bundles 11, 21 are processed as disclosed herein. Whether or not enhancement steps A' and C' optionally include squeeze rollers 105 and the squeezing process for removing excess quantities of PCM 104, the PCM 104 is effectively contained in combination with the filament bundles 11, 21 in the array of substantially continuous tubular pockets or sleeves 101 formed between the opposing first surfaces 17 and 27 of respective first and second films 16 and 26 by adhesions 103 between mutually adhered lengthwise strip portions 19 and 29.

Figure 33:
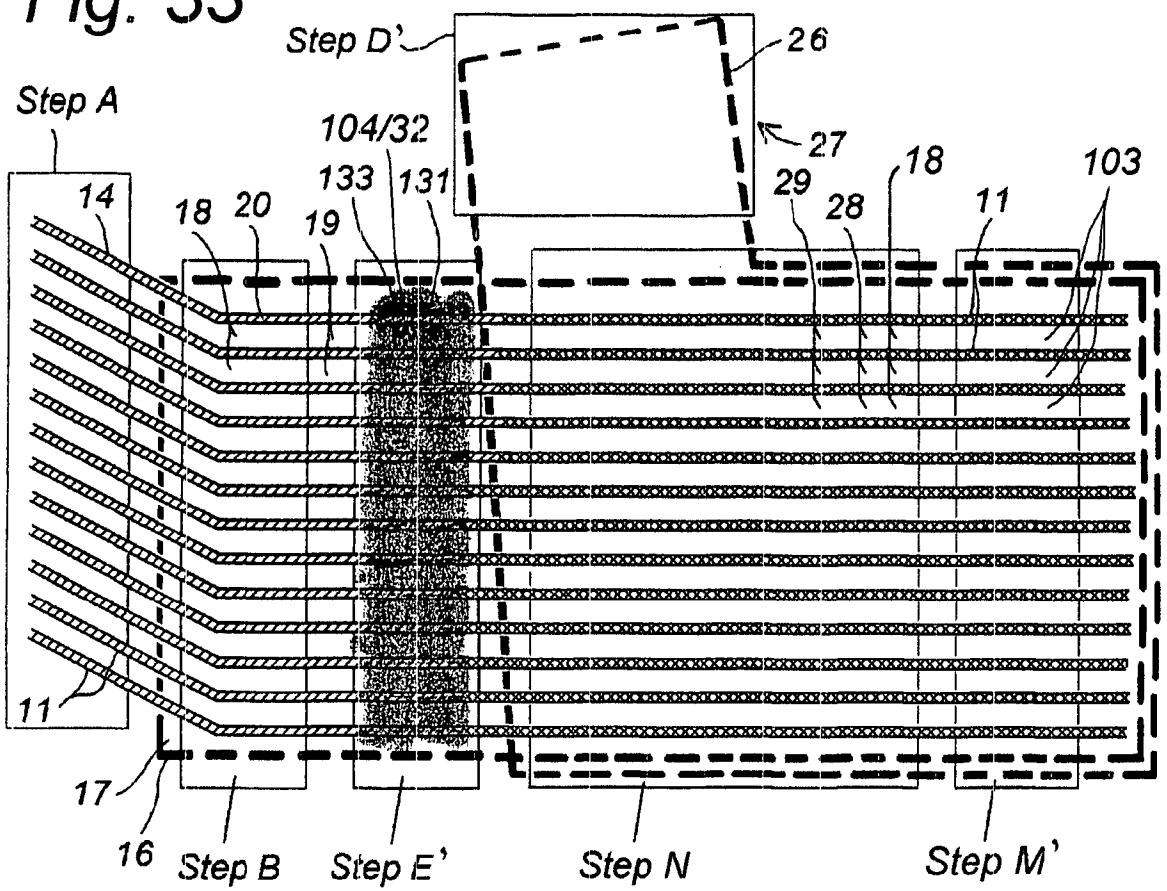
FIG. 33 illustrates an alternative enhanced embodiment, wherein the phase change material or PCM is used in combination with only a single array of filament bundles.

FIG. 33 illustrates an alternative enhanced embodiment, wherein the phase change material or PCM 104 is used in combination with the filament bundles 11 of the first array 14 only. Here, when the PCM 104 is compatible with the coupling agent 32, the PCM 104 is combined with the coupling agent 32 in the alternative enhancing step E' is substituted for step E of depositing the substantially continuous deposits 31 and 33 of coupling agent 32. Substituted alternative enhancing step E' is operated for depositing substantially continuous deposits 131 of combined PCM 104 and coupling agent 32 on the exposed surfaces 20 of the filament bundles 11 of the first array 14 and simultaneously depositing substantially continuous deposits 133 of combined PCM 104 and coupling agent 32 onto the exposed substantially continuous thin lengthwise strip portions 19 of the first surface 17 of the corresponding first film 16 that show between the adjacent fiber bundles 11 of the first array 14. Thereafter, at least the combined PCM 104 component is permitted to soak into and impregnate the filament bundles 11, as disclosed herein.

The method includes an alternative step D' is substituted for step D of the method for applying the second film 26 to the second array 24 of filament bundles 21. In the alternative enhancing step D' the second single layer array 24 of filament bundles 21 is omitted. Rather, the second or "right" film application roller or mandrel 25 supplies the second or "right" film 26 of thin and flexible polyethylene or other suitable material.

The step F of interlaying the spaced apart filament bundles 11 of the first array 14 with the spaced apart filament bundles 21 of the second array 24 is omitted because the second array 24 of filament bundles 21 is omitted. Instead, the alternative enhanced method includes an alternative step N in which the second film 26 is applied to the filament bundles 11 of the first array 14 after accomplishment of alternative step D' of supplying the second or "right" film 26.

In the alternative step N the second film 26 is applied to the exposed surfaces of filament bundles 11 of the first array 14 which causes a first surface 27 of the second film 26 to be arranged in close proximity to the exposed surfaces 20 of the filament bundles 11 of the first array 14 and also in close proximity to the exposed substantially continuous thin lengthwise strip portions 19 of the first surface 17 of the corresponding first film 16 that show between the adjacent fiber bundles 11 of the first array 14. The substantially continuous thin lengthwise strip portions 29 of the first surface 27 of the second film 26 are positioned adjacent to the exposed substantially continuous thin lengthwise strip portions 19 of the first surface 17 of the first film 16 that show between the adjacent fiber bundles 11 of the first array 14.

The method includes a step M' of anchoring, bonding or otherwise adhering at least a portion of the exposed surfaces 20 of filament bundles 11 of the first array 14 to corresponding substantially continuous thin lengthwise portions 107 of the first surface 27 of the second film 26 between the lengthwise strip portions 29. As more clearly illustrated in FIG. 34, step M' of the method includes, substantially simultaneously with the anchoring, bonding or otherwise adhering at least a portion of the exposed surfaces 20 of the filament bundles 11 of the first array 14 to corresponding lengthwise portions 107 of the first surface 27 of the second film 26, substantially simultaneously anchoring, bonding or otherwise adhering at least a portion of the exposed substantially continuous thin lengthwise strip portions 19 of the first surface 17 of the first film 16 that show between the adjacent fiber bundles 11 of the first array 14 to corresponding portions of the exposed substantially continuous thin lengthwise strip portions 29 of the first surface 27 of the second film 26. Accordingly, substantially continuous thin lengthwise strip adhesions 103 are formed lengthwise strip portions 19 of the first surface 17 of the first film 16 and lengthwise strip portions 29 of the first surface 27 of the second film 26. Accordingly, the filament bundles 11 of the first array 14 that are soaked or impregnated with the PCM 104 are substantially fully contained within substantially continuous tubular pockets or sleeves 101 formed between the opposing first surfaces 17 and 27 of the first and second films 16 and 26 by adhesions 103 between mutually adhered lengthwise strip portions 19 and 29.

Figure 34:
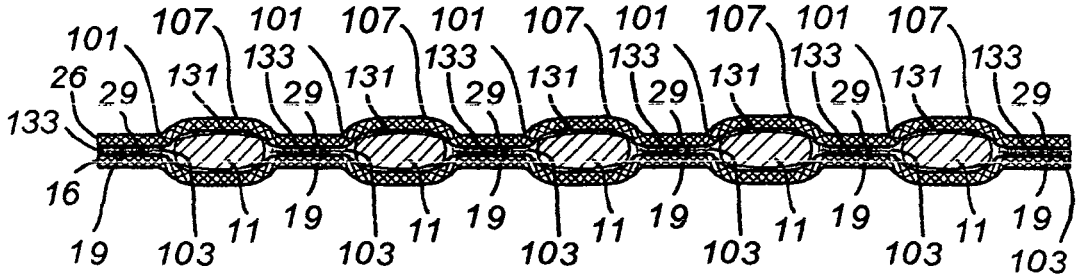
FIG. 34 is a cross-section of the alternative enhanced embodiment of the novel laminate structure illustrated in FIG. 33.
Figure 35:
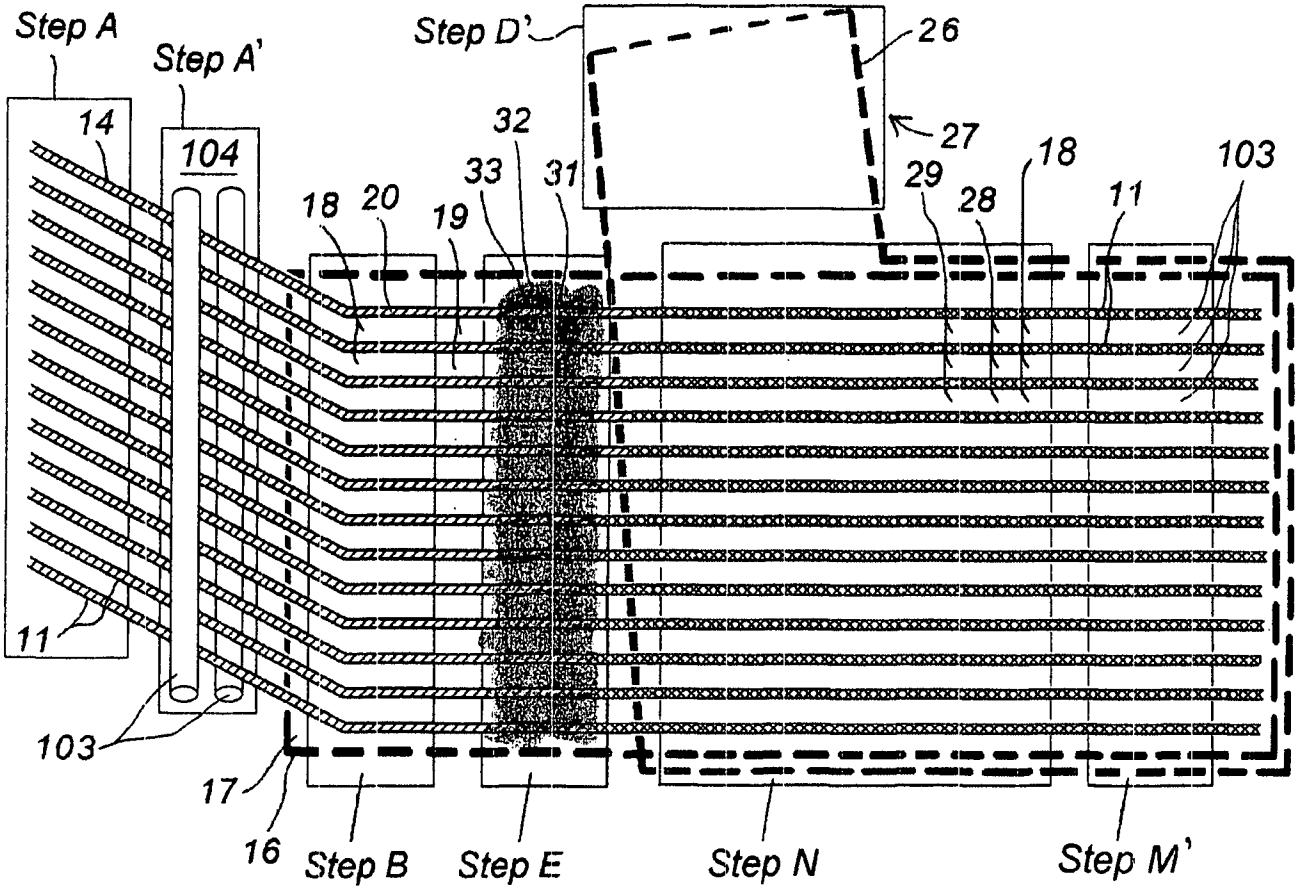
FIG. 35 illustrates another alternative enhanced embodiment of the novel laminate structure, wherein the phase change material or PCM is used in combination with only a single array of filament bundles.

FIG. 35 illustrates another alternative enhanced embodiment, wherein the phase change material or PCM 104 is used in combination with the filament bundles 11 of the first array 14 only. Here, the phase change material or PCM 104 is used in combination with the alternative embodiment of the laminate structure 10 illustrated in FIG. 33 and FIG. 34. For example, the optional enhanced embodiment includes the enhancement step A' disclosed herein of initially soaking or impregnating the filament bundles 11 of the first array 14 in phase change material or PCM 104 before the filament bundles 11 are encased in the first and second films 16, 26 in step N.

Accordingly, in step B the first single layer array 14 of filament bundles 11 are passed over a first or "left" film application roller or mandrel 15 where a first or "left" film 16 of thin and flexible polyethylene or other suitable material is applied to the first array 14 of filament bundles 11. In step E substantially continuous deposits 31 of a coupling agent 32 are deposited onto the exposed surfaces 20 of the filament bundles 11 of the first array 14 that face away from the first film 16. The alternative step D' is practiced for supplying the second or "right" film 26. In step N the second film 26 is applied to the filament bundles 11 of the first array 14 after accomplishment of alternative step D'. This alternative enhanced embodiment includes step M' of anchoring, bonding or otherwise adhering at least a portion of the exposed surfaces 20 of filament bundles 11 of the first array 14 to corresponding substantially continuous thin lengthwise portions 107 of the first surface 27 of the second film 26 between the lengthwise strip portions 29, as more clearly illustrated in FIG. 34.

Figure 36:
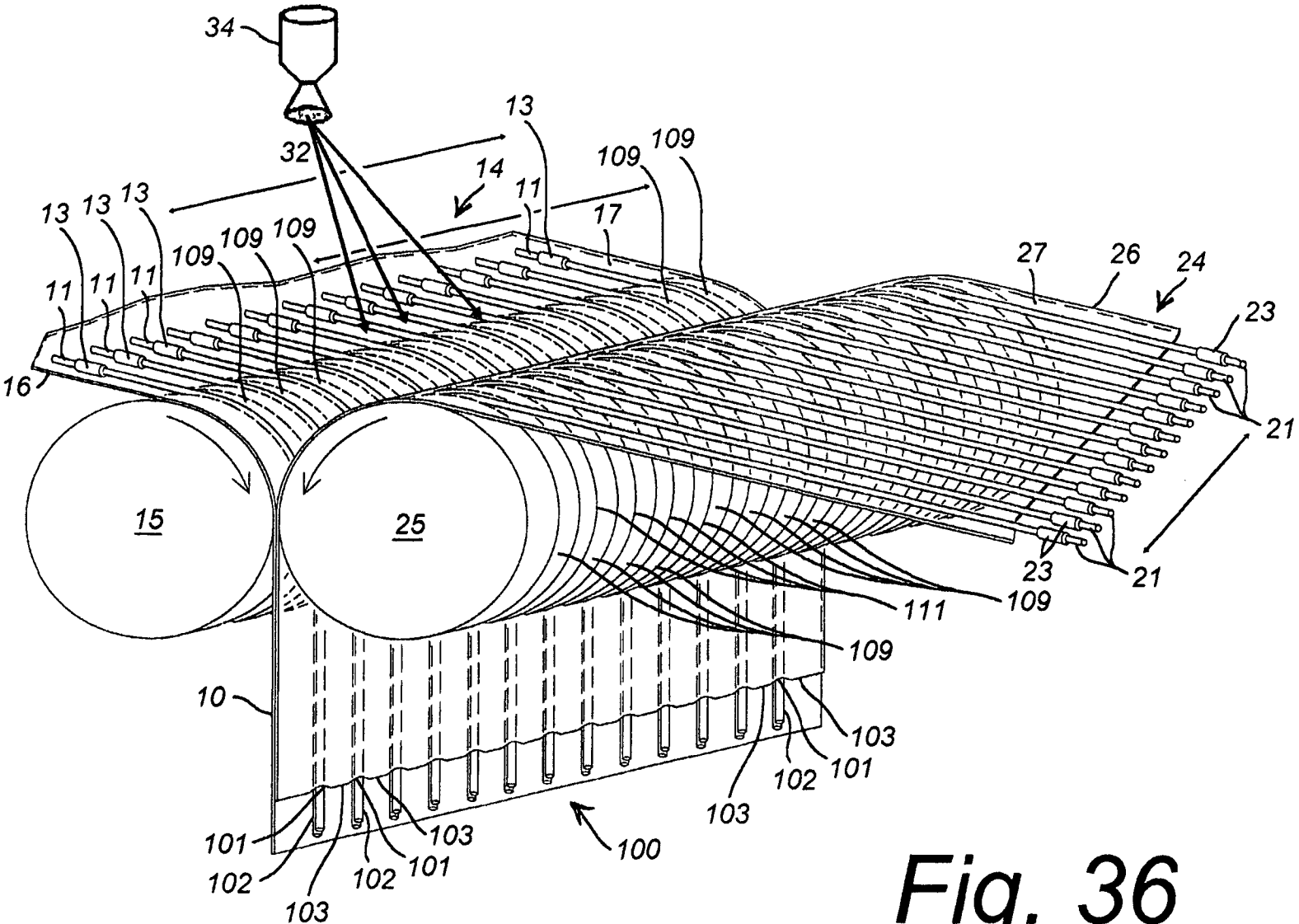
FIG. 36 enhanced embodiment of the ballistic-resistant laminate structure, wherein a maximum quantity of the phase change material or PCM is retained on the filament bundles, for example, by modifying one or both of the mandrels with a plurality of continuous circumferential grooves with substantially uniform spacings therebetween, the grooves being sized to receive respective filament bundles and corresponding portions of the thin films without squeezing excess quantities of the PCM from the filament bundles.

FIG. 36 illustrates the PCM-enhanced embodiment of the ballistic-resistant laminate structure 10 illustrated in FIG. 31 and FIG. 32 wherein, after impregnation with PCM 104 as disclosed herein, a maximum quantity of the PCM 104 is retained on the filament bundles 11 and 21 and contained within the substantially continuous tubular pockets or sleeves 101 formed between the opposing first surfaces 17 and 27 of the first and second films 16 and 26. According to one embodiment, one or optionally both of the mandrels 15 and 25 is enhanced to avoid squeezing excess quantities of the PCM 104 from the filament bundles 11 and 21. For example, one or both of the mandrels 15 and 25 is optionally formed with a plurality of continuous circumferential grooves 109 with substantially uniform spacings 111 therebetween; the spacings 111 are substantially the same as the spacings 18 and 28 between adjacent filament bundles 11 and 21, as disclosed herein. According to one embodiment, the grooves 109 are sized larger than filament bundles 11 and 21 so as to provide room for respective films 16 and 26 to drape into each groove 109 with one of the filament bundles 11, 21 without compressing the corresponding filament bundle 11, 21 or squeezing the PCM 104 therefrom.

Respective comb guides 13 and 23 parallelize the arrays 14 and 24 for spacing the filament bundles 11 and 21 to match the grooves 109 of the respective mandrels 15 and 25.

The applicator 34 deposits the substantially continuous deposits 31, 33 of the coupling agent 32 at any convenient point in the process. Thereafter, the substantially continuous thin lengthwise strip adhesions 103 between the double layer filaments 102 of spaced array 100 are formed along the spacings 111 between adjacent grooves 109.

Figure 37:
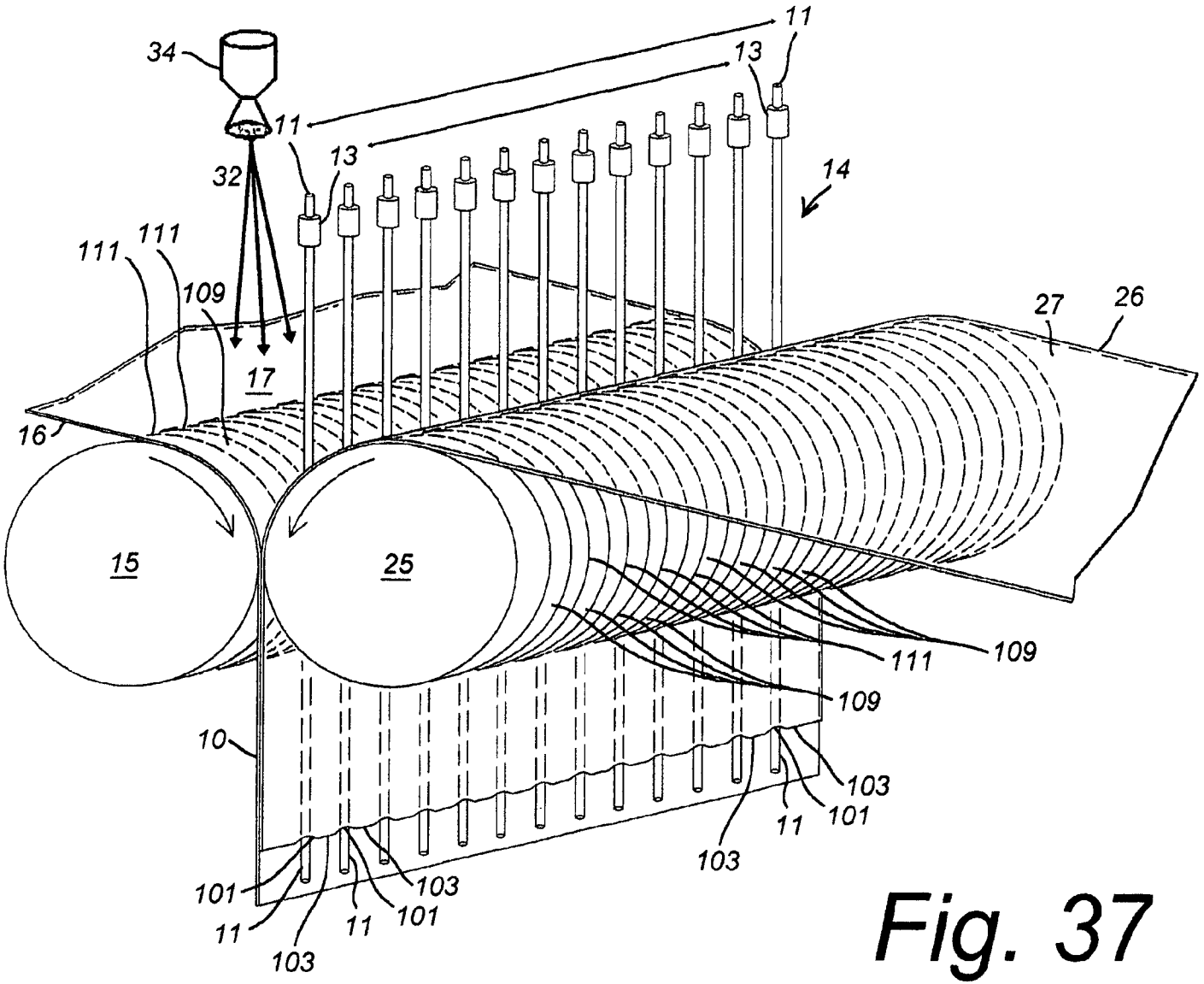
FIG. 37 illustrates the PCM-enhanced embodiment of FIG. 33 through FIG. 35 wherein, wherein the phase change material or PCM is used in combination with only a single array of filament bundles.

FIG. 37 illustrates the PCM-enhanced embodiment of FIG. 33 through FIG. 35 wherein, after impregnation with the PCM 104 as disclosed herein, a maximum quantity of the PCM 104 is retained on the filament bundles 11 and contained within the substantially continuous tubular pockets or sleeves 101 formed between the opposing first surfaces 17 and 27 of the first and second films 16 and 26. However, here the filament bundles 11 of the first array 14 are not expected to adhere to the first surface 27 of the second film 26. Rather, the filament bundles 11 of the first array 14 are substantially free floating but yet substantially fully contained within the substantially continuous tubular pockets or sleeves 101 formed between the opposing first surfaces 17 and 27 of the first and second films 16 and 26 by adhesions 103 between the mutually adhered lengthwise strip portions 19 and 29. This substantially free floating yet contained nature of the filament bundles 11 increases flexibility of the resulting assembled PCM-enhanced ballistic-resistant laminate structure 10. For example, when the PCM 104 is not compatible with the coupling agent 32, i.e., inhibits effective adhesion of the coupling agent 32, the exposed surfaces 20 of filament bundles 11 do not bond to the lengthwise portions 107 of the first surface 27 of the second film 26.

According to one embodiment, one or optionally both of the mandrels 15 and 25 is enhanced to avoid squeezing excess quantities of the PCM 104 from the single array 14 of filament bundles 11. For example, one or both of the mandrels 15, 25 is optionally formed with a plurality of the continuous circumferential grooves 109 with substantially uniform spacings 111 therebetween, as disclosed herein. The spacings 111 are substantially the same as the spacings 18 between adjacent filament bundles 11 of the array 14, as disclosed herein. According to one embodiment, the grooves 109 are sized larger than filament bundles so as to provide room for respective films 16 and 26 to drape into each groove 109 occupied by one of the filament bundles 11 without compressing the corresponding filament bundle 11.

The comb guides 13 parallelize the array 14 for spacing the filament bundles 11 to match the grooves 109 of the mandrels 15, 25.

The applicator 34 deposits the substantially continuous deposits 33 of the coupling agent 32 onto the exposed surface 17 or 27 of one of the films 16 and 26 at any convenient point in the process. Thereafter, the substantially continuous thin lengthwise strip adhesions 103 between the filament bundles 11 of the array 14 are formed along the spacings 111 between adjacent grooves 109 for forming the substantially continuous tubular pockets or sleeves 101 housing the filament bundles 11 soaked in phase change material or PCM 104, as well as substantially containing any excess PCM 104 carried along with the filament bundles 11.

While the preferred and additional alternative embodiments of the invention have been illustrated and described, it will be appreciated that various changes can be made therein without departing from the spirit and scope of the invention. Accordingly, the inventor makes the following claims.

What is claimed is:

1. A ballistic-resistant laminate assembly, comprising:

a first thin and flexible film;

a stacked pair of first and second substantially linear arrays of unidirectionally-oriented bundles of high strength filaments with filament bundles of the first array each being substantially aligned with adjacent filament bundles of the second array, wherein:

the filament bundles of the first array being arranged in a substantially parallel configuration proximate to the first film with adjacent filament bundles of the first array being spaced-apart and portions of the first film being exposed in substantially continuous spacings therebetween, and the filament bundles of the second array being proximate to respective filament bundles of the first array, and with the portions of the first film exposed in the spacings between adjacent filament bundles of the first array being further exposed in spacings between adjacent filament bundles of the second array, at least intermittent portions of one or more of the filament bundles of the first array being coupled to respective adjacent parallel filament bundles of the second array;

a second thin and flexible film arranged proximate to the filament bundles of the second array opposite from the first film with portions of the second film being exposed in substantially continuous spacings between the adjacent spaced-apart filament bundles of the second array;

a coupling agent adhering at least intermittent portions of the first and second films exposed in the spacings between adjacent filament bundles of the first and second arrays; and wherein interconnections between portions of the coupling agent adhering the first and second films and portions of a coupling agent adhering the filament bundles of the first array and filament bundles of the second array are intermittent and the interconnections further range from minimal to none.

2. The assembly of claim 1, wherein the filament bundles of the first array are further substantially continuously coupled to corresponding parallel filament bundles of the second array.

3. The assembly of claim 2, wherein the first and second films further comprise respective first and second films selected from the group of films consisting of: plastic films, thermoplastic films, and metallic films.

4. The assembly of claim 2, wherein the coupling agent coupling the filament bundles of the first array to the filament bundles of the second array selected from the group of coupling agents consisting of: an adhesive, and a polymer.

5. The assembly of claim 1, wherein the first and second films further form substantially continuous tubular sleeves substantially containing the filament bundles of the first and second arrays.

6. The assembly of claim 5, wherein at least one or more of the coupled filament bundles of the first and second arrays are further substantially free floating in the substantially continuous tubular sleeves formed between the first and second films.

7. The assembly of claim 1, further comprising substantially continuous deposits of a liquid-to-solid phase change material (PCM) comprising hard particles suspended in a flowable liquid medium deposited on the filament bundles at least one of the first and second arrays, the PCM adapted for transitioning from liquid phase to solid phase responsively to a physical impact thereto.

8. A ballistic-resistant laminate assembly, comprising:

a first thin and flexible film;

a stacked pair of first and second substantially linear arrays of unidirectionally-oriented bundles of high strength filaments arranged in stacked relationship with the stacked filament bundles being aligned in substantially parallel orientation with adjacent stacked filament bundles being spaced-apart with gaps therebetween, wherein:

the filament bundles of the first array are further arranged proximate to the first film, the filament bundles of the first array are at least intermittently coupled to respective corresponding adjacent filament bundles of the second array; and a second thin and flexible film arranged proximate to the filament bundles of the second array opposite from the first film and at least intermittently coupled to the first film in the gaps between adjacent stacked filament bundles of the first and second arrays; and wherein interconnections between a coupling agent adhering the first film to the second film and a coupling agent adhering the filament bundles of the first array to the filament bundles of the second array are intermittent and further range from minimal to none.

9. The assembly of claim 8, further comprising substantially continuous tubular sleeves formed between the first film and the second film by adhesions therebetween in the gaps between adjacent stacked filament bundles of the first and second arrays.

10. The assembly of claim 9, wherein the filament bundles of the first and second arrays are movable in the substantially continuous tubular sleeves formed between the first and second films.

11. The assembly of claim 10, wherein the first and second films further comprise respective first and second films selected from the group of films consisting of: plastic films, thermoplastic films, and metallic films.

12. The assembly of claim 10, wherein each of the coupling agents further comprises a coupling agent selected from the group of coupling agents consisting of: an adhesive, and a polymer.

13. The assembly of claim 8, further comprising substantially continuous deposits of a liquid-to-solid phase change material (PCM) comprising hard particles suspended in a flowable liquid medium deposited on the filament bundles at least one of the first and second arrays, the PCM adapted for transitioning from liquid phase to solid phase responsively to a ballistic impact thereto.

14. A ballistic-resistant laminate assembly, comprising:

first and second thin and flexible films;

a stacked pair of first and second arrays of unidirectionally-oriented bundles of high strength filaments with filament bundles of the first array each being arranged in stacked relationship with filament bundles of the second array in substantially parallel orientation with corresponding filament bundles of the first array, and with adjacent stacked filament bundles further being spaced apart and forming substantially continuous spacings therebetween, wherein:

the filament bundles of the first array are further arranged proximate to the first film with thin linear portions of the first film positioned between adjacent spaced apart filament bundles of the first array, the filament bundles of the second array being further arranged proximate to the second film with thin linear portions of the second film positioned between adjacent spaced apart filament bundles of the second array, and at least intermittent deposits of a coupling agent adhering the filament bundles of the first array to the filament bundles of the second array;

a coupling agent compatible with at least each of the first and second films, at least intermittent deposits of the coupling agent being coupled between the thin linear portions of the first film and thin linear portions of the second film corresponding thereto in the spacings between adjacent stacked filament bundles; and wherein interconnections between a coupling agent adhering the first film to the second film and a coupling agent adhering the filament bundles of the first array to the filament bundles of the second array are intermittent and further range from minimal to none.

15. The assembly of claim 14, wherein the first and second films further form substantially continuous tubular sleeves by adhesions therebetween.

16. The assembly of claim 14, wherein the stacked filament bundles of the first and second array are further movable in the substantially continuous tubular sleeves formed between the first and second films.

17. The assembly of claim 16, further comprising substantially continuous deposits of a liquid-to-solid phase change material (PCM) comprising hard particles suspended in a flowable liquid medium deposited on the filament bundles at least one of the first and second arrays, the PCM adapted for transitioning from liquid phase to solid phase responsively to a ballistic impact thereto.

18. A method of assembling a ballistic-resistant laminate assembly, the method comprising:

forming a first plurality of unidirectionally-oriented bundles of high strength filaments into a first single layer array with adjacent filament bundles being spaced apart by a gap;

applying a first film of thin and flexible material to the first array of filament bundles;

depositing deposits of a coupling agent onto the filament bundles of the first array and onto strip portions of the first film exposed in the gap between the adjacent fiber bundles of the first array;

forming a second plurality of unidirectionally-oriented bundles of high strength filaments into a second single layer array with adjacent filament bundles being spaced apart by a gap substantially corresponding the gap between the filament bundles of the first array;

stacking the spaced apart filament bundles of the first array onto corresponding spaced apart filament bundles of the second array;

contacting the filament bundles of the second array with the deposits of the coupling agent deposited onto the filament bundles of the first array;

adhering at least intermittent portions of one or more of the filament bundles of the first array to the filament bundles of the second array;

applying a second film of thin and flexible material to the second array of filament bundles opposite from the first film;

contacting the filament bundles of the second array with the second film;

contacting strip portions of the second film with the deposits of the coupling agent deposited onto the strip portions of the first film exposed in the gaps between the adjacent fiber bundles of the first array;

adhering at least intermittent portions of the strip portions of the second film to the strip portions of the first film exposed in the gap between the adjacent fiber bundles of the first array; and wherein interconnections between the coupling agent adhering the strip portions of the second film to the strip portions of the first film and the coupling agent adhering the filament bundles of the first array to the filament bundles of the second array are intermittent and further range from minimal to none.

19. The method of claim 18, further comprising flattening the filament bundles of the first and second arrays across the first film.

20. The method of claim 18, further comprising applying a liquid-to-solid phase change material (PCM) to the filament bundles of at least one of the first and second arrays.

21. The method of claim 20, further comprising applying a liquid-to-solid phase change material (PCM) to the filament bundles of both of the first and second arrays.

* * * * *